US009222160B2

(12) United States Patent
Numano et al.

(10) Patent No.: US 9,222,160 B2
(45) Date of Patent: Dec. 29, 2015

(54) COIL MATERIAL AND METHOD FOR MANUFACTURING THE SAME

(75) Inventors: Masatada Numano, Osaka (JP); Michimasa Miyanaga, Osaka (JP); Takeshi Uchihara, Osaka (JP); Yukihiro Oishi, Osaka (JP); Nozomu Kawabe, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 528 days.

(21) Appl. No.: 13/387,965

(22) PCT Filed: Mar. 22, 2011

(86) PCT No.: PCT/JP2011/056722

§ 371 (c)(1),
(2), (4) Date: Jan. 30, 2012

(87) PCT Pub. No.: WO2011/122390

PCT Pub. Date: Jun. 10, 2011

(65) Prior Publication Data

US 2012/0128997 A1 May 24, 2012

(30) Foreign Application Priority Data

| | | |
|---|---|---|
| Mar. 30, 2010 | (JP) | 2010-076718 |
| Jul. 12, 2010 | (JP) | 2010-157656 |
| Jul. 12, 2010 | (JP) | 2010-158144 |
| Mar. 8, 2011 | (JP) | 2011-050885 |

(51) Int. Cl.
*C22F 1/06* (2006.01)
*C22C 23/02* (2006.01)

(Continued)

(52) U.S. Cl.
CPC ..... *C22F 1/00* (2013.01); *B22D 11/001* (2013.01); *B22D 11/124* (2013.01); *B22D 11/22* (2013.01);

(Continued)

(58) Field of Classification Search
CPC ..... C22F 1/00; C22F 1/06; B22D 11/001; B22D 11/124; B22D 11/22; C22C 23/00
USPC ..... 164/437, 448, 438, 440, 488, 489, 490; 148/666, 667
See application file for complete search history.

(56) References Cited

U.S. PATENT DOCUMENTS 5,409,757 A * 4/1995 Muzzy et al. ..... 428/114
2005/0236135 A1* 10/2005 Liang et al. ..... 164/480

(Continued)

FOREIGN PATENT DOCUMENTS

CN 1980759 A 6/2007
CN 101512028 A 8/2009

(Continued)

OTHER PUBLICATIONS

Notification of the First Office Action for corresponding Chinese Patent Application No. 201180003026.6 dated Mar. 5, 2013, pp. 1-16.

(Continued)

*Primary Examiner* — Roy King
*Assistant Examiner* — Jenny Wu
(74) *Attorney, Agent, or Firm* — Ditthavong & Steiner, P.C.

(57) ABSTRACT

A coil material capable of contributing to an improvement of the productivity of a high-strength magnesium alloy sheet and a method for manufacturing the coil material are provided. Regarding the method for manufacturing a coil material through coiling of a sheet material formed from a metal into the shape of a cylinder, so as to produce the coil material, the sheet material is a cast material of a magnesium alloy discharged from a continuous casting machine and the thickness t (mm) thereof is 7 mm or less. The sheet material 1 is coiled with a coiler while the temperature T (° C.) of the sheet material 1 just before coiling is controlled to be a temperature at which the surface strain ((t/R)×100) represented by the thickness t and the bending radius R (mm) of the sheet material 1 becomes less than or equal to the elongation at room temperature of the sheet material 1.

38 Claims, 10 Drawing Sheets

(51) Int. Cl.

| | |
|---|---|
| ***B22D 11/00*** | (2006.01) |
| ***B21B 3/00*** | (2006.01) |
| ***C22F 1/00*** | (2006.01) |
| ***B22D 11/124*** | (2006.01) |
| ***B22D 11/22*** | (2006.01) |
| ***C22C 23/00*** | (2006.01) |

(52) U.S. Cl.
CPC . *C22C 23/00* (2013.01); *C22F 1/06* (2013.01); *B21B 3/003* (2013.01); *Y10T 428/12292* (2015.01)

(56) References Cited

U.S. PATENT DOCUMENTS

| | | | | |
|---|---|---|---|---|
| 2008/0311423 | A1 | 12/2008 | Numano et al. | |
| 2011/0217514 | A1 * | 9/2011 | Okuda et al. | 428/142 |

FOREIGN PATENT DOCUMENTS

| | | | | |
|---|---|---|---|---|
| JP | 01-133642 | A | | 5/1989 |
| JP | 03-087339 | A | | 4/1991 |
| JP | 05-078799 | A | | 3/1993 |
| JP | 2003-340552 | A | | 12/2003 |
| JP | 2005125389 | A | * | 5/2005 |
| JP | 2006-263784 | A | | 10/2006 |
| JP | 2007-098470 | A | | 4/2007 |
| JP | 2007-275915 | A | | 10/2007 |
| JP | 2008-163361 | A | | 7/2008 |
| WO | WO 2006/003899 | A1 | | 1/2006 |
| WO | WO 2008029497 | A1 | * | 3/2008 |

OTHER PUBLICATIONS

Office Action for corresponding Korean Patent Application No. 10-2012-7001982 dated Aug. 20, 2013, 13 pages.
International Search Report for PCT Application No. PCT/JP2011/056722 dated Jun. 21, 2011, pp. 1-2.

* cited by examiner

Formula(1-1) $$\frac{\frac{(T-80)^2}{450}+30}{2800}=\frac{t}{R\min}$$

Formula(2-1) $$\frac{\frac{(T-80)^2}{450}+30}{4000}=\frac{t}{R\min}$$

COIL MATERIAL AND METHOD FOR MANUFACTURING THE SAME

CROSS-REFERENCE TO RELATED APPLICATION

The present application is a national phase application of PCT Application No. PCT/JP2011/056722, filed on Mar. 22, 2011, and claims priority to Japanese Application No. 2010-076718, filed on Mar. 30, 2010, Japanese Application No. 2010-158144, filed on Jul. 12, 2010, Japanese Application No. 2010-157656, filed on Jul. 12, 2010, and Japanese Application No. 2011-050885, filed on Mar. 8, 2011, the entire contents of which are herein incorporated by reference.

TECHNICAL FIELD

The present invention relates to a coil material formed from a magnesium alloy cast material suitable for a raw material for a magnesium alloy structural member and a method for manufacturing the coil material, a magnesium alloy sheet produced from the coil material and a method for manufacturing the magnesium alloy sheet, and a coil material coiler suitable for production of the coil material. In particular, the present invention relates to a coil material capable of contributing to an improvement of the productivity of a high-strength magnesium alloy structural member and a method for manufacturing the coil material.

BACKGROUND ART

A light-weight magnesium alloy exhibiting excellent specific strength and specific rigidity has been studied as a constituent material for various structural members, e.g., a housing, of mobile electric and electronic devices, such as, cellular phones and laptop computers. As for structural members formed from the magnesium alloy, cast materials (for example, the AZ 91 alloy based on the American Society for Testing Materials Standard) by a die casting process or a thixomold process are the mainstream. In recent years, a structural member produced from a sheet, which is formed from a magnesium alloy for elongation typified by the AZ 31 alloy based on the American Society for Testing Materials Standard and which has been subjected to press forming, has been used.

PTL 1 discloses that a rolled sheet formed from the AZ 91 alloy or an alloy containing Al to the same extent as the AZ 91 alloy is produced under a specific condition and the resulting sheet is subjected to press forming.

PTL2 discloses a technology to produce a cast material serving as a raw material for such a rolled sheet with a twin-roll type continuous casting apparatus. The twin-roll type continuous casting apparatus is an apparatus to obtain a sheet cast material by feeding a molten material to between a pair of casting rolls rotating in directions opposite to each other and quenching and solidifying the molten material between the casting rolls. The cast material produced with this twin-roll type continuous casting apparatus is usually coiled on a take-up reel after being formed through rolling and the like, and is carried to another secondary forming site on a take-up reel basis or is shipped to a customer.

PTL3 discloses a casting nozzle suitable for a twin-roll type continuous casting apparatus. This nozzle is formed by combining a pair of main body sheets disposed discretely and rectangular parallelepiped side dams disposed on both sides of the two main body sheets, and an opening portion is rectangular.

Among the magnesium alloys formed by the above described technologies, magnesium alloys having high strength and exhibiting excellent corrosion resistance, flame retardancy, and the like have large contents of additive elements. For example, in the case where cast materials are compared, the AZ 91 alloy having a content of Al larger than that of the AZ 31 alloy has high tensile strength and excellent corrosion resistance as compared with the AZ 31 alloy. Furthermore, regarding magnesium alloys having the same composition, in general, the strength of a formed material, which is produced by subjecting a cast material to various types of plastic forming, e.g., rolling, forging, drawing, or pressing, is higher than the strength of the cast material.

CITATION LIST

Patent Literature

PTL 1: Japanese Unexamined Patent Application Publication No. 2007-098470

PTL 2: Japanese Unexamined Patent Application Publication No. 1-133642

PTL 3: Japanese Unexamined Patent Application Publication No. 2006-263784

SUMMARY OF INVENTION

Technical Problem

In general, the above described structural members, e.g., the housing, are desired to have high strength and rigidity and exhibiting excellent corrosion resistance and the like. However, it is difficult to produce a structural member formed from a magnesium alloy having excellent characteristics, e.g., the strength and the corrosion resistance with high productivity.

For example, in the case where a magnesium alloy structural member exhibiting excellent strength is produced by subjecting a rolled sheet to plastic forming, e.g., pressing, it is expected that the use of continuously produced long lengths of rolled sheet as a raw material can increase the yield and enhance the productivity as compared with the use of a unit length of rolled sheet cut into a predetermined length as a raw material. In order to produce long lengths of rolled sheet, it is necessary to produce long lengths of cast material serving as the raw material for the rolled sheet. Moreover, in order that the raw material can be fed to a rolling mill or the like continuously, it is desirable that the long lengths of cast material serving as the raw material is made into a cast coil material by being coiled into the shape of a cylinder. However, it is difficult to produce long lengths of cast material formed from a high-strength magnesium alloy and coil the long lengths of body.

The present inventors performed studies on a sheet cast material having a tensile strength of 250 MPa or more as an example of a raw material to produce a high-strength magnesium alloy structural member. Typically, the tensile strength of the cast material can be made 250 MPa or more by specifying the total content of elements, e.g., Al, Zr, Y, Si, Zn, and Ca, serving as additive elements of the magnesium alloy to be 7.3 percent by mass or more. Examples of magnesium alloys satisfying the above described tensile strength include Mg—Al–Zn based magnesium alloys having an Al content of 7.3 percent by mass or more.

In order to produce a cast material, which has an excellent surface texture in such a way that there is substantially no discoloration (mainly due to oxidation) in the surface and which has a small number of defects in such a way that center line segregation is at a very low level, by using such a magnesium alloy containing high concentration of additive elements, it is necessary to quench and solidify a molten metal. In particular, it is preferable that casting is performed in association with cooling in such a way that the temperature of a sheet material just after being discharged from a casting machine becomes 350° C. or lower, and preferably 250° C. or lower. Casting into a thin sheet is suitable for achievement of the above described cooling condition to obtain the above described high-quality cast material. However, when the cast material is thin, the temperature is lowered at a rate of about 25° C./min to 50° C./min after casting through natural cooling. In this regard, the magnesium alloy has a hexagonal crystalline structure (hexagonal close-packed structure) and, therefore, has poor plastic formability at room temperature. Consequently, the plastic formability is degraded because of the above described lowering of temperature, so that it is difficult to coil with a coiler in the related art.

Furthermore, in the case where the above described magnesium alloy containing high concentration of additive elements is used, a cast texture becomes a texture in which additive element-rich fragile micro segregation is generated in the vicinity of a columnar crystal. Because of this segregation, the cast material is poor in toughness and a curvature at which bending can be performed without an occurrence of cracking or the like (allowable bending radius) is limited. Therefore, regarding the coiler in the related art, it is difficult to coil continuously produced long lengths of cast material without an occurrence of cracking or the like. It is considered that the radius of a winding drum of the coiler is increased in accordance with the above described allowable bending radius. However, it is necessary that the drive mechanism of the coiler is upsized because of upsizing of the winding drum and, therefore, that idea is impractical. Moreover, even when the radius of the winding drum is increased, bending with a radius smaller than the radius of the winding drum may be applied in the vicinity of a coiling start place by a chuck portion grasping the coiling start place of the cast material. Consequently, the above described problems may not be solved only by changing the radius of the winding drum.

On the other hand, a magnesium alloy, e.g., the AZ31 alloy, containing low concentration of additive elements has toughness to the extent at which bending can be performed even at room temperature. Therefore, in the case where long lengths of cast material is produced, coiling can be performed easily, but a high-strength magnesium alloy structural member is not obtained.

Meanwhile, coiling can be performed in the case where the temperature of a sheet material just after being discharged from the casting machine is not lowered in contrast to that described above and the temperature is allowed to remain in the state of being high to some extent. However, in this case, regarding the coiled cast material, defects resulting from portions not made into solid solution and degradation in surface state because of oxidation or the like occur. Consequently, it is necessary to remove these defects and the surface layer before the following step, e.g., rolling, so that the productivity of the magnesium alloy structural member is reduced.

In addition, in the case where the casting nozzle having an rectangular opening, as described in PTL 3, is used in production of the above described cast coil material, it is difficult to continuously and stably produce a cast sheet having a predetermined width.

In the case where a cast sheet is produced through continuous casting, the flow rate of a molten metal of the edge portion of the cast sheet tends to be reduced as compared with that of the central portion of the cast sheet and, thereby, chipping, cracking, and the like occur easily in the edge portion. Consequently, in the case where the cast sheet is subjected to forming, e.g., rolling, both edge portions of the cast sheet are trimmed to adjust to a predetermined width before the forming. If a crack of the edge portion extends to the central portion, the amount of trimming increases, the predetermined width cannot be ensured, and the yield is reduced. Therefore, in production of the long lengths of cast material, it is desired to reduce cracking of the edge portion. However, sufficient study has not been performed previously on a manufacturing method and the shape of a cast material which can reduce cracking of the edge portion effectively.

Regarding the above described casting nozzle formed from the main body sheets and the side dams, a molten metal present in the vicinity of the end portion in the nozzle is cooled by the side dams, and solidified materials may be generated locally in the vicinity of the side dams. The solidified materials further cool a surrounding molten metal and reduce the flow rate of the molten metal flowing toward the opening portion of the nozzle, so that the solidification region is expanded gradually, the solidification region may come into contact with a mold, and chipping and cracking may occur to a large extent in the edge portion of the cast sheet. In particular, in the casting nozzle having the rectangular opening, the flow rate of the molten metal flowing in the vicinity of the corner portion in the nozzle tends to become smaller relative to the flow rate of the molten metal flowing in the places other than the corner portion in the nozzle. In addition, the temperature of the molten metal filled into the above described corner portion tends to be lowered relatively as compared with the molten metal flowing in the places other than the corner portion. Consequently, a molten metal filled into the corner portion in the nozzle is solidified easily, and problems may occur in that chipping and cracking of the edge portion occur, as described above, because of the solidified materials or, at worst, a cast sheet having a desired sheet width is not obtained because of solidification and casting is stopped necessarily.

In order to improve the productivity of the cast sheet, a plastic forming material by using this sheet as a raw material, and the like for the purpose of reducing a unit cost of production, for example, it is necessary to continuously produce long lengths, e.g., 30 m or more, and in particular 100 m or more, of cast sheet, and it is not desired to stop casting on the way. Therefore, developments of a manufacturing method which can continuously stably produce long lengths of cast sheet and a shape of cast material, which can be continuously stably produced, have been desired.

Accordingly, it is an object of the present invention to provide a coil material capable of contributing to an improvement of the productivity of a high-strength magnesium alloy structural member and a method for manufacturing the coil material.

Furthermore, it is another object of the present invention to provide a magnesium alloy sheet suitable for a raw material for a magnesium alloy structural member and a method for manufacturing the magnesium alloy sheet.

Moreover, it is another object of the present invention to provide a coil material coiler suitable for production of the coil material formed from a cast material of a magnesium alloy.

Solution to Problem

Regarding production of a coil material of a cast material formed from a magnesium alloy, the present invention proposes a manufacturing method in which the temperature of the cast material just before coiling is specified in production of a sheet cast material through continuous casting. Specifically, in the method for manufacturing a coil material, a sheet material formed from a metal is coiled into the shape of a cylinder so as to produce a coil material. This sheet material is a cast material of a magnesium alloy discharged from a continuous casting machine and the thickness t (mm) thereof is 7 mm or less. Furthermore, the following coiling step is included.

Coiling step: a cast coil material having an elongation $el_r$ at room temperature of 10% or less is obtained through coiling with a coiler while the temperature T (° C.) of the above described sheet material just before coiling is controlled to be a temperature at which the surface strain ((t/R)×100) represented by the thickness t and the bending radius R (mm) of the sheet material becomes less than or equal to the elongation $el_r$ (%) at room temperature of the sheet material.

According to the manufacturing method of the present invention, even a cast material (sheet material) having relatively low toughness, for example, the elongation $el_r$ at room temperature is 10% or less, can be coiled easily and, therefore, a cast coil material can be produced with high productivity. In particular, in the case where the above described manufacturing method according to the present invention is used, even when, for example, the radius of a winding drum to coil a cast material is smaller than the allowable bending radius of the cast material at room temperature, the cast material can be coiled easily through the use of the winding drum. Furthermore, it can be said that the magnesium alloy cast coil material having a sheet material thickness of 7 mm or less is a magnesium alloy cast coil material in which segregation in the sheet material is at a low level. This is because if the produced sheet material has a small thickness, the sheet material is quenched and solidified promptly up to the central portion during quenching and solidification in casting and, thereby, segregation does not occur easily in the cast material.

According to the above described manufacturing method of the present invention, the following coil material according to the present invention is obtained. The coil material according to the present invention is formed from a cast sheet of magnesium alloy, has a thickness of 7 mm or less and an elongation at room temperature of 10% or less, and is coiled into the shape of a cylinder.

This cast coil material can be coiled having a small diameter in spite of being a cast material having relatively law toughness. Put another way, the cast coil material has high strength and, therefore, a high-strength magnesium alloy structural member can be obtained by using this cast coil material as a raw material. Furthermore, the size of the cast coil material can be miniaturized. Consequently, it is expected that the above described manufacturing method according to the present invention and the coil material according to the present invention can contribute to an improvement of the productivity of a high-strength magnesium alloy structural member.

The magnesium alloy sheet according to the present invention is obtained by subjecting the coil material according to the present invention to the following various treatments.

(1) A sheet is produced by performing a heat treatment at a heat treatment temperature Tan (K) satisfying Tan≥Ts×0.8 for a holding time of 30 minutes or more, where the solidus temperature of the magnesium alloy constituting the coil material is represented by Ts (K) and the heat treatment temperature is represented by Tan (K).

(2) A sheet is produced by using the part constituting t×90% or more of the thickness t of the coil material.

(3) A sheet is produced by subjecting the coil material to rolling with a reduction ratio of 20% or less.

The coil material obtained by the manufacturing method according to the present invention and the coil material according to the present invention can have long lengths. Therefore, by using them as raw materials, the raw material can be fed to a secondary step, e.g., rolling, continuously. Consequently, by using these cast coil materials, magnesium alloy structural members including the magnesium alloy sheet according to the present invention can be produced with high productivity.

Furthermore, the following coil material coiler according to the present invention is suitable for use in the above described method for manufacturing a coil material according to the present invention. This coiler is a coil material coiler to coil the sheet material continuously produced with a continuous casting machine into the shape of a cylinder. This sheet material is formed from a magnesium alloy. Moreover, this coiler is provided with a chuck portion to grasp an end portion of the above described sheet material and a heating device to heat the region, which is grasped by the above described chuck portion, of the above described sheet material.

This coiler is provided with the predetermined heating device and, thereby, the temperature of the sheet material at the start of coiling and just after start of coiling can be controlled easily.

Advantageous Effects of Invention

According to the method for manufacturing a coil material of the present invention, the coil material according to the present invention can be produced with high productivity easily. The magnesium alloy sheet according to the present invention can be produced with high productivity by the method for manufacturing a magnesium alloy sheet according to the present invention through the use of the coil material according to the present invention. The coil material coiler according to the present invention is suitable for use in production of the coil material according to the present invention.

BRIEF DESCRIPTION OF DRAWINGS

FIG. 1 is a schematic explanatory diagram for explaining a production step of a coil material according to the present invention. FIG. 1A shows an example in which a heating device is provided between a continuous casting machine and a coiler.

FIG. 1 is a schematic explanatory diagram for explaining a production step of a coil material according to the present invention. FIG. 1B shows an example in which a coiler is provided with a heating device.

FIG. 2 is a graph showing the relationship between the heating temperature T and the surface strain (t/R), where bending was applied with various bending radii R regarding production of magnesium alloy cast coil materials having various thicknesses t in Test example 1-1.

FIG. 3 is a graph showing the relationship between the heating temperature T and the surface strain (t/R), where bending was applied with various bending radii R regarding production of magnesium alloy cast coil materials having various thicknesses t in Test example 1-2.

FIG. 4A is a schematic sectional view showing an example of a chuck portion provided in a coiler.

FIG. 4B is a schematic sectional view showing an example of a chuck portion, where bending nearly along the shapes of a convex portion and a concave portion is applied to a sheet material.

FIG. 5 is a graph showing the relationship between the test temperature and the elongation after fracture, where a twin-roll cast material of the AZ91 alloy was subjected to a tensile test.

FIG. 6 is a schematic diagram of production facilities for a magnesium alloy cast coil material shown in Example 2-1. FIG. 6A is a top view.

FIG. 6 is a schematic diagram of production facilities for a magnesium alloy cast coil material shown in Example 2-1. FIG. 6B is a side view.

FIG. 7 is a schematic diagram for explaining the definitions of w and d with respect to a magnesium alloy cast coil material. Here, w represents the width of a coil material and d represents a maximum distance between a straight line circumscribing both end surfaces of the coil material to the perimeter surface of the coil material.

FIG. 8A is a schematic perspective view schematically showing a cast sheet constituting a magnesium alloy cast coil material in Example 3-2.

FIG. 8B is a transversal sectional view schematically showing a casting nozzle used for a method for manufacturing a magnesium alloy cast coil material in Example 3-2.

FIG. 9A is a schematic perspective view schematically showing a cast sheet constituting a magnesium alloy cast coil material in Example 3-3.

FIG. 9B is a transversal sectional view schematically showing a casting nozzle used for a method for manufacturing a magnesium alloy cast coil material in Example 3-3.

FIG. 10A is a perspective view.

FIG. 10B is a plan view, viewed from the main body sheet side.

DESCRIPTION OF EMBODIMENTS

Figure 1A:
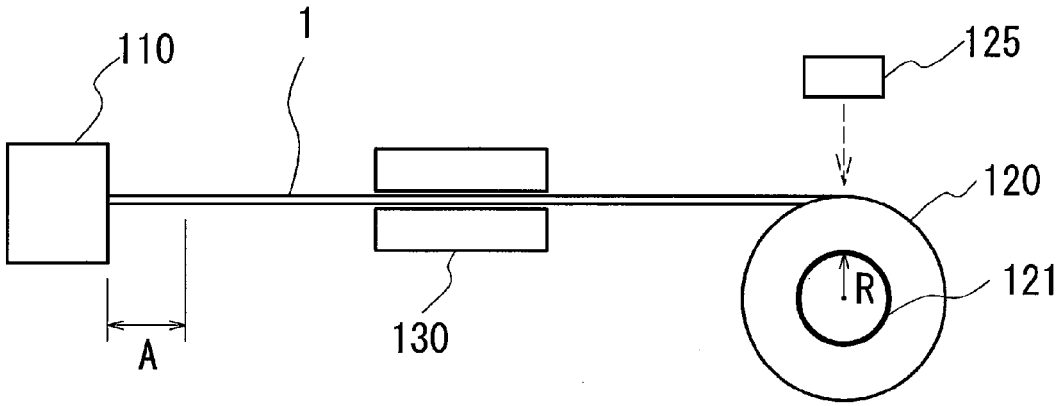
[FIG. 1A]

The present invention will be described below in more detail. In the descriptions with reference to the drawings, the same elements are indicated by the same reference numerals. Furthermore, dimensional ratios in the drawing do not always agree with those in the following explanations.

EXAMPLE 1-1

[Cast Coil Material, Magnesium Alloy Sheet]

(Composition)

Examples of magnesium alloys constituting the above described coil material according to the present invention and the magnesium alloy sheet according to the present invention include those having various compositions, in which additive elements are contained in Mg (the remainder: Mg and impurities). In particular, in the present invention, examples of cast materials cast continuously include those having various compositions and satisfying the elongation at room temperature of 10% or less. Furthermore, compositions satisfying the tensile strength at room temperature of 250 MPa or more in addition to the above described specification of elongation are preferable. Typical examples of compositions include those having a total content of additive elements of 7.3 percent by mass or more. As the additive elements increase, the strength, the corrosion resistance, and the like become excellent. However, if the content is too large, defects due to segregation, cracking due to reduction in plastic formability, and the like occur easily. Therefore, it is preferable that the total content is 20 percent by mass or less. As for the additive element, for example, at least one of element selected from the group consisting of Al, Si, Ca, Zn, Mn, Sr, Y, Cu, Ag, Sn, Li, Zr, Ce, Be, and rare earth elements (excluding Y and Ce) is mentioned.

In particular, a Mg—Al based alloy containing Al has excellent corrosion resistance, and as the amount of Al increases, the corrosion resistance tends to become excellent. However, if the Al content is too large, reduction in plastic formability is brought about. Therefore, a favorable Al content of the Mg—Al based alloy is 2.5 percent by mass or more and 20 percent by mass or less. In particular, 7.3 percent by mass or more and 12 percent by mass or less is preferable. It is preferable that the total content of additive elements other than Al of the Mg—Al based alloy is 0.01 percent by mass or more and 10 percent by mass or less, and in particular 0.1 percent by mass or more and 5 percent by mass or less. Regarding the Mg—Al based alloy, intermetallic compounds, such as, $Mg_{17}Al_{12}$, are precipitated, and particles of the precipitates are present while being dispersed uniformly, so that the strength and the rigidity can increase. Specific examples of Mg—Al based alloys include AZ based alloys (Mg—Al—Zn based alloy, Zn: 0.2 percent by mass to 1.5 percent by mass), AM based alloys (Mg—Al—Mn based alloy, Mn: 0.15 percent by mass to 0.5 percent by mass), AS based alloys (Mg—Al—Si based alloy, Si: 0.3 percent by mass to 4 percent by mass), and others, e.g., Mg—Al—RE (rare earth element) based alloys, specified by the American Society for Testing Materials Standard. Examples of AZ based alloys include alloys containing 8.3 percent by mass to 9.5 percent by mass of Al and 0.5 percent by mass to 1.5 percent by mass of Zn, typically the AZ91 alloy.

In particular, it is preferable that about 0.01 percent by mass to 10 percent by mass of at least one of element of Si, Ca, Zn, and Sn in total is contained because the mechanical characteristics, e.g., the strength, the rigidity, the toughness, and the heat resistance, of the magnesium alloy can be improved. Among the above described elements, regarding the Mg—Si based alloy containing Si and the Mg—Ca based alloy containing Ca, precipitates ($Mg_2Si$, $Al_2$ Ca, and the like) are generated easily as compared with $Mg_{17}Al_{12}$, and it is expected that a large effect of improving the strength is exerted by the precipitates. Furthermore, the above described elements, such as, Si, Ca, Zn, and Sn, are industrially useful because reserves are relatively large, and the elements are available inexpensively.

It was ascertained that even when a very small amount, such as, 1 percent by mass, of the elements listed above other than Al, Si, Ca, Zn, and Sn are contained, the effect of improving the characteristics, in particular strength, of the magnesium alloy was exerted. However, regarding the cast material, the toughness tends to become poor.

The above described effect of improve strength due to dispersion of precipitate particles depends on the content of the additive elements mainly. For example, regarding Si which forms an intermetallic compound with Mg, a strength improving effect 2.71 times (the value obtained by dividing the atomic weight 76 of $Mg_2Si$ by the amount (28×1) in accordance with the atomic ratio of Si, where the atomic weight of Mg is specified to be 24 and the atomic weight of Si is specified to be 28) the content thereof can be expected. Regarding Al which forms an intermetallic compound with Mg, a strength improving effect 2.26 times (the value obtained by dividing the atomic weight 732 of $Mg_{17}Al_{12}$ by the amount (27×12) in accordance with the atomic ratio of Al, where the atomic weight of Mg is specified to be 24 and the atomic weight of Al is specified to be 27) the content thereof can be expected. Furthermore, regarding Ca which forms an intermetallic compound with Al, a strength improving effect 2.35 times (the value obtained by dividing the atomic weight 94 of $Al_2Ca$ by the amount (40×1) in accordance with the atomic ratio of Ca, where the atomic weight of Al is specified to be 27 and the atomic weight of Ca is specified to be 40) the content thereof can be expected. However, in the case where both Al and Ca are contained, Al 1.35 times (the value obtained by dividing the amount 54 of $Al_2Ca$ in accordance with the atomic ratio of Al by the amount 40 in accordance with the atomic ratio of Ca, where the atomic weight of Al is specified to be 27 and the atomic weight of Ca is specified to be 40) the content of Ca is consumed for precipitation with Ca and, therefore, the amount of Al contributing to an improvement of strength is reduced. Consequently, in the case where both Al and Si are contained, a strength improving effect specified by 2.71×(Si content)+2.26×(Al content) is expected. Meanwhile, in the case where at least one of three elements, Al, Si, and Ca is contained, a strength improving effect specified by a formula value D=2.71×(Si content)+2.26×[(Al content) - 1.35 x (Ca content)]+2.35×(Ca content) is expected. It can be said that the above described formula value D represented by using the contents (percent by mass) of Al, Si, and Ca shows the degree of contribution of Al, Ca, and Si to the improvement of strength and, in addition, indicates the vulnerability of the magnesium alloy. As a result of examination of the present inventors, it was found that regarding the cast material satisfying D 14.5, cracking did not occur easily even at a low temperature of 150° C. or lower. Then, as for the indicator of a preferable content of the additive elements, it is proposed that the magnesium alloy contains at least one of element selected from the group consisting of Al, Ca, and Si and satisfies the above described formula value D≥14.5. In this regard, an element (solid solution type element) which forms a solid solution with an a phase of the magnesium alloy so as to increase strength does not follow this formula value D.

(Mechanical Characteristics)

The coil material according to the present invention satisfies the elongation at room temperature (about 20° C.) of 10% or less (excluding 0%). As the tensile strength increases, the elongation tends to become small, and those having the above described elongation of 5% or less, and furthermore 4% or less are mentioned depending on the composition of the magnesium alloy. In order to produce the cast coil material stably, the elongation at room temperature is preferably 0.5% or more. The cast coil material according to the present invention has somewhat low elongation at room temperature, but the surface texture is excellent, as described below. Therefore, cracking and the like do not occur easily in a tensile test at high temperatures, and it can be said that a large elongation at high temperatures is one of the features. For example, the elongation at 200° C. of 10% or more, and preferably 40% or more is satisfied. In this regard, in the case where production is performed by the above described manufacturing method according to the present invention, the elongation during coiling is in the state of being increased and, therefore, there is no problem even when the elongation at room temperature of the cast coil material according to the present invention after being coiled is somewhat low as described above.

Moreover, it is preferable that the coil material according to the present invention is a high-strength material satisfying the tensile strength at room temperature (about 20° C.) of 250 MPa or more in addition to the above described specification of the elongation. The tensile strength of the above described cast coil material varies mainly depending on the composition. For example, the tensile strength at room temperature of 280 MPa or more may be satisfied depending on the type and the content of the additive element.

When the minimum bending radius (typically, diameter radius of the sheet material coiled into the shape of a cylinder) of the coil material having a thickness oft according to the present invention is represented by Rmin, the cast coil material is in the state of being provided with a surface strain represented by t/Rmin, as described later. The cast coil material according to the present invention can be in the form of being provided with a large surface strain, for example, a form satisfying t/Rmin≥0.02, and furthermore a form satisfying t/Rmin≥0.025, by being produced under a specific production condition, as described above.

(Form)

The coil material according to the present invention is in the form in which a thin tubular material having a thickness t of 7 mm or less is coiled in the shape of a cylinder. This cast coil material is produced by the manufacturing method, in which the temperature of the tubular material just before coiling is controlled, as described above, according to the present invention and, thereby, there is substantially no crack nor discoloration due to oxidation or the like in the surface thereof throughout the length including the coiling start place grasped by the chuck portion of the coiler, and the surface texture is excellent. More specifically, for example, a form in which particles of precipitates present in the inside are fine (average particle diameter: 50 μm or less) and a flaw having a depth of 100 μm or more and a width of 100 μm or less and forming an angle of 5° or more with the longitudinal direction of the coil material is not present in the surface is mentioned. Alternatively, a form in which an oxide film is very thin or is substantially not present is mentioned. Quantitatively, a form in which the maximum thickness of the oxide film is 0.1 mm or less, preferably 10 μm or less, and more preferably 1 μm or less is mentioned. As the oxide film present on the surface of the cast coil material becomes thinner, the surface texture becomes excellent. Therefore, it does not matter that the whole thickness is not uniform insofar as the maximum thickness satisfies the above described range. In this regard, the thicknesses of the coil material according to the present invention and the magnesium alloy sheet according to the present invention are specified to be average thicknesses, where thicknesses in the direction orthogonal to the longitudinal direction (the width direction regarding the cast coil material) are measured at arbitrary points in the longitudinal direction. In the case where the coiling start place grasped by the chuck portion of the coiler is taken as a stock allowance and is not used in after forming, it is allowed that there are very fine flaws and traces of grasping in the coiling start place insofar as cracking or the like does not occur throughout the length of the sheet material other than the coiling start place grasped by the chuck portion of the coiler.

It is preferable that the length of the sheet material constituting the coil material according to the present invention is 30 m or more. A more preferable length of the cast material is 50 m or more, and particularly preferable length is 100 m or more. In the case where the length of the cast material is 30 m or more, many magnesium alloy structural members can be produced from one coil material. If many magnesium alloy structural members can be produced from one coil material, it may become possible that one coil material is sufficient for the coil material to be prepared at a site of production of the magnesium alloy structural members. In that case, a space for placing the coil material at the site can be saved, the productivity of the magnesium alloy structural member is improved, and the production cost of the magnesium alloy structural member can be reduced significantly.

The magnesium alloy sheet according to the present invention is produced from the above described coil material according to the present invention serving as a raw material and, therefore, is a thin sheet having a thickness of 7 mm or less. Examples of specific forms include a form in which the coil material is cut into a predetermined shape, length, or the like, a form in which a surface treatment, e.g., polishing, a corrosion protection treatment, such as, a chemical conversion treatment or an anodization treatment, or painting, is applied to the cast coil material, a form in which a heat treatment is applied to the cast coil material, a form in which plastic forming, e.g., rolling, is applied to the cast coil material, and a form in which the above described cutting, the surface treatment, the heat treatment, the plastic forming, and the like are applied in combination to the cast coil material (for example, a form in which cutting→heat treatment→plastic forming→surface treatment are applied).

The coil material according to the present invention has high strength and excellent surface texture, as described above. Therefore, it is expected that the coil material even in the form of being cut simply, as described above, can be used as a magnesium alloy sheet sufficiently. A magnesium alloy sheet having further excellent surface texture and corrosion resistance can be produced by applying the above described surface treatment, so that a commercial value is enhanced. In the case where the above described surface treatment, e.g., polishing, or plastic forming, e.g., rolling, is applied, a magnesium alloy sheet having a thickness smaller than the thickness of the coil material according to the present invention used as the raw material can be produced. The magnesium alloy sheet subjected to the above described plastic forming undergoes work hardening and, therefore, has further excellent strength and rigidity as compared with those of the above described cast coil material. In this regard, in the case where only the above described cutting, a corrosion protection treatment, painting, and a heat treatment are applied, the thickness of the magnesium alloy sheet is substantially the same as the thickness of the coil material according to the present invention used as the raw material.

The above described magnesium alloy sheet according to the present invention can be used as a magnesium alloy structural member on an as-is basis or be used as a raw material for producing a magnesium alloy structural member by applying plastic forming, e.g., press forming, such as, bending or drawing, to this sheet.

[Manufacturing method]

(Method for Manufacturing Coil Material)

The coil material according to the present invention is produced by coiling a sheet material, which is produced by feeding a magnesium alloy in a molten state to a continuous casting machine, with a coiler. At that time, the cast coil material is obtained by controlling the temperature of the sheet material just before coiling.

<Casting and Temperature Control of Sheet Material Just after Casting>

Regarding the continuous casting process, quenching solidification can be performed and, therefore, even in the case where the content of the additive elements is large, segregation, oxides, and the like can be reduced, and a cast material having excellent plastic formability, e.g., rolling, is obtained. As for continuous casting, various methods, e.g., a twin-roll casting process, a twin-belt casting process, and a belt and wheel casting process, are mentioned. However, the twin-roll casting process and the twin-belt casting process are suitable for production of the sheet material. The twin-roll casting process is particularly preferable because quenching solidification can be performed by using a mold exhibiting excellent rigidity and thermal conductivity and having a large thermal capacity. Regarding the method, in which both surfaces of the cast material are subjected to quenching solidification, typified by the twin-belt casting process and the twin-roll casting process, center line segregation may be generated. It was ascertained that no problem occurred in use as a raw material for the above described magnesium alloy structural member insofar as the presence region of center line segregation was within the range of ±20%, and in particular within the range of ±10%, from the center in the thickness direction of the cast material.

It is preferable that the cooling rate in casting is 100° C./sec or more because precipitates generated at the interface of the columnar crystal can be made fine, such as, 20 μm or less.

The thickness of the sheet material cast is specified to be 7 mm or less because if the thickness is too large, segregation occurs easily. In particular, 5 mm or less is preferable because segregation can be reduced sufficiently. The lower limit of the thickness of the sheet material is 1 mm, more preferably 2 mm, and further preferably about 4 mm.

In this casting, it is preferable that the temperature of the sheet material just after being discharged from the continuous casting machine is specified to be 350° C. or lower. Consequently, a cast material, which has an excellent surface texture in such a way that there is substantially no discoloration (mainly due to oxidation) in the surface and which has a small number of defects in such a way that center line segregation is at a very low level, can be obtained. In order to bring this sheet material to 350° C. or lower, in particular 250° C. or lower in line, adjustment of the contact time of the molten metal with the mold (hereafter referred to as a mold contact time) and a cooling temperature of the mold and, furthermore, disposition of a forced cooling device at a position downstream from and close to the continuous casting machine are mentioned.

Most of all, in the case where the twin-roll casting machine is used, desirably, casting is performed in such a way that the temperature of the sheet material in the range from the discharge port of the continuous casting machine to 500 mm, in particular 150 mm, in the moving direction of the sheet material becomes 350° C. or lower, and preferably 250° C. or lower. In the case where casting is performed in such a way that the temperature becomes 350° C. or lower, and preferably 250° C. or lower substantially just after discharge from the continuous casting machine, excessive generation of impurities in crystal and precipitates and growth of impurities in crystal and precipitates can be suppressed, and coarse impurities in crystal and precipitates serving as starting points of cracking and the like can be reduced. Furthermore, in this case, the thickness of an oxide film naturally generated on the surface of the cast material can be specified to be 1 μm or less, and a cast material having an excellent surface texture is obtained without removing the oxide film in a downstream operation.

As described above, it is preferable that the temperature of the sheet material just after being discharged from the continuous casting machine is lower from the viewpoint of suppression of generation of segregation and growth of particles constituting the organization. In particular, it is more preferable that the temperature of the sheet material within 500 mm, especially 150 mm, from the above described discharge port reaches 150° C. or lower in the range concerned. However, as described later, in the case where the temperature of the sheet material just before coiling is controlled by heating, if the temperature of the sheet material just after casting is too low, energy to heat the sheet material to the predetermined temperature just before the coiling increases. Consequently, the lower limit of the sheet material just after casting is room temperature or higher, preferably 80° C. or higher, and particularly preferably about 120° C. or higher. Meanwhile, in the case where the temperature of the sheet material just before the coiling is controlled by thermal insulation or the like without heating the sheet material discharged from the continuous casting machine, the temperature of the sheet material just after casting is adjusted in such a way as not to become lower than the predetermined temperature just before the coiling and not to become excessively low. Examples thereof include that the temperature is specified to be 150° C. or higher, and in particular 200° C. or higher and is specified to be equal to or lower than the temperature of the sheet material just after casting.

<Temperature Control of Sheet Material in Casting to Coiling>

Regarding the sheet material obtained by the above described casting, the temperature is adjusted between the casting machine and the coiler to control the temperature of the sheet material just before the coiling. This temperature T (° C.) of the sheet material just before the coiling is specified to be a temperature at which the surface strain ((t/R)×100) represented by the thickness t and the bending radius R (mm) of the sheet material becomes less than or equal to the elongation $el_r$ (%) at the temperature T (° C.) of the sheet material, and preferably less than or equal to the elongation $el_r$ (%) at room temperature of the sheet material. It is believed that cracking associated with coiling of the sheet material occurs mainly because a surface strain generated in the sheet material becomes larger than the elongation of the sheet material. This elongation of the sheet material increases as the temperature becomes higher, as described above. Therefore, a cast coil material, in which cracking does not occur easily or no cracking occurs, can be obtained by controlling the temperature of the sheet material just before the coiling in the above described manner. In particular, in the case where the surface strain is relatively large, it is effective to, for example, control the temperature of the sheet material just before the coiling, where t/R≥0.01. As for more specific minimum bending radius Rmin, 500 mm or less, more preferably 400 mm or less, further preferably 300 mm or less, and most of all 250 mm or less is mentioned.

As for this temperature control, specifically, a case where the temperature just before the coiling is adjusted by cooling once the temperature of the sheet material just after casting to a predetermined temperature or lower and, then, performing heating and a case where the sheet material after casting is not heated, and a temperature decrease of the sheet material from the casting machine to the coiler is suppressed by heat insulation, adjustment of the standing time for cooling, and the like are mentioned.

In the case where the temperature of the sheet material just before the coiling is controlled by heating, it is preferable that the above described sheet material is cooled once to 150° C. or lower between the continuous casting machine and a heating apparatus to perform the above described heating. In order to perform this cooling in line, for example, adjustment of the distance from the discharge port of the continuous casting machine (as for the twin-roll casting machine, the point at which sandwiching with a pair of rolls is finished) to a point at which heating is performed, as described later, the mold contact time, and the cooling temperature of the mold, followed by execution of standing for cooling, is mentioned. Furthermore, cooling can be performed more effectively by disposing a forced cooling device between the above described discharge port and the above described point at which heating is performed. As for the forced cooling, air cooling with an air blast, such as, a fan and an issue of cold air in a jet, wet cooling, such as, mist spraying to spray a liquid refrigerant, e.g., water and a reducing liquid, and the like are mentioned.

After the temperature of the sheet material is cooled once to 150° C. or lower, the resulting sheet material is heated and, thereby, the temperature of the sheet material just before the coiling is controlled to a predetermined temperature described later. As for this heating, an appropriate heating device can be used. Examples of heating devices include an atmosphere furnace in which a heated gas is filled in a furnace and is recycled, an induction heating furnace, a direct electrical heating furnace in which a sheet material is directly energized, a radiant heater, a commercially available electric heater, and others, such as, a high-temperature liquid dipping apparatus to perform heating through dipping into a high-temperature liquid e.g., oil.

As this heating temperature becomes higher, the elongation of the sheet material is improved, so that even when a bending radius in coiling is small, cracking and the like does not occur substantially. However, if the heating temperature is too high, precipitates may be generated, growth of impurities in crystal and precipitates may occur, the surface may be discolored through oxidation or the like, and the cast coil material after being coiled may be heat shrunk so as to cause cracking, deformation, and the like. Therefore, the heating temperature is preferably 350° C. or lower. In this regard, in the case where the heating temperature is specified to be higher than 350° C., it is preferable that heating is performed in an atmosphere having a low oxygen concentration because oxidation can be prevented. The oxygen concentration in the atmosphere at this time is preferably less than 10 percent by volume. However, even in the atmosphere having a low oxygen concentration, if the heating temperature is too high, problems may occur in that, for example, precipitates may grow, as described above. Therefore, the heating temperature is preferably 400° C. or lower.

Meanwhile, in the case where the sheet material after casting is not heated and a temperature decrease of the sheet material from the casting machine to the coiler is suppressed, it is mentioned that, for example, at least a part of the sheet material from the continuous casting machine to the coiler is surrounded by a heat reserving material (heat insulating material). In particular, it is preferable that the temperature of the sheet material just discharged from the continuous casting machine is adjusted to a relatively high temperature in the range of 350° C. or lower and, thereby, the temperature of the sheet material just before the coiling is not lowered significantly.

Here, the case where bending with a bending radius $R_b$ is applied to the sheet material having a thickness oft is considered. At this time, a surface strain $t/R_b$ corresponding to the magnitude of the bending radius $R_b$ is applied to the same sheet material having a thickness oft. Table I show the relationship between the thickness t (mm) of the sheet material, the bending radius $R_b$ (mm), and the surface strain $((t/R_b)\times 100\ (\%))$.

TABLE I

| Thickness | Bending radius $R_b$ (mm) | | | | | |
|---|---|---|---|---|---|---|
| t (mm) | 100 | 200 | 300 | 400 | 500 | 600 |
| 4.0 | 4.0% | 2.0% | 1.3% | 1.0% | 0.8% | 0.7% |
| 5.0 | 5.0% | 2.5% | 1.7% | 1.3% | 1.0% | 0.8% |
| 7.0 | 7.0% | 3.5% | 2.3% | 1.8% | 1.4% | 1.2% |

Figure 5:
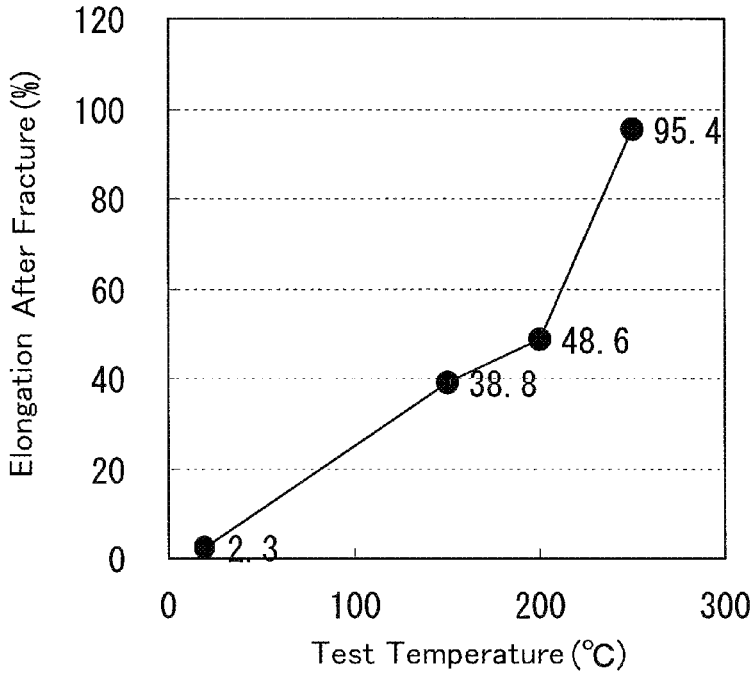
[FIG. 5]

The elongation (elongation after fracture) of the magnesium alloy increases as the temperature is raised. FIG. 5 shows the relationship between the test temperature (° C.) and the elongation after fracture (%), where a twin-roll cast material of the AZ91 alloy was subjected to a tensile test.

As is clear from FIG. 5, although the twin-roll cast material of the AZ91 alloy has a small elongation at room temperature, the elongation increases by raising the temperature. Furthermore, in the case where the thickness t of the sheet material is small and the bending radius $R_b$ is small, as shown in Table I, the surface strain t/Rb is more than the elongation at room temperature (2.3%) shown in FIG. 5. Consequently, it is clear that in this case, if coiling is performed at room temperature, it is difficult to coil because cracking or the like occurs. Then, in the manufacturing method according to the present invention, the temperature of the sheet material before the coiling is controlled appropriately, as described above.

As shown in Table I, the surface strain $t/R_b$ in accordance with the thickness t and the bending radius $R_b$ is applied to the sheet material. Therefore, it can be said that preferably, the temperature of the sheet material just before the coiling is set in accordance with this surface strain. In consideration of such circumstances, as one form of the present invention, it is proposed that the temperature of the above described sheet material is controlled in such a way as to make the the temperature T (° C.) satisfy the following Formula (1), where the minimum bending radius in coiling with the above described coiler is represented by Rmin (mm) and the temperature of the above described sheet material just before coiling is represented by T (° C.). Moreover, it is preferable that the temperature of the above described sheet material is controlled in such a way as to satisfy the following Formula (2). In this regard, t/Rmin is specified to be within the range in which T can take on a real number.

[Equation 1]

$$\frac{\frac{(T-80)^2}{450}+30}{2800} \geqq \frac{t}{R\min} \qquad \text{Formula (1)}$$

$$\frac{\frac{(T-80)^2}{450}+30}{4000} \geqq \frac{t}{R\min} \qquad \text{Formula (2)}$$

Alternatively, it is preferable that the temperature T (° C.) just before the coiling is specified to be 150° C. or higher in the case where the surface strain is large, specifically t/Rmin>0.01, be 120° C. or higher in the case where the surface strain is relatively small, specifically 0.008≤t/Rmin≤0.01, and be 100° C. or higher in the case where the surface strain is small, specifically t/Rmin<0.008.

The control of the temperature T (° C.) of the above described sheet material just before the coiling is performed with respect to at least portions subjected to bending not satisfying the allowable bending radius of the sheet material at room temperature regarding whole length of the above described sheet material from the coiling start place (typically, the place grasped by a chuck portion provided in the coiler) to the coiling finish place. That is, the temperature control may be applied to whole length of the above described sheet material from the coiling start place to the coiling finish place, or the temperature control may be applied to only a part thereof In the case where the above described sheet material is coiled with the coiler, the coiling radius increases as the number of coiled layers increases. Therefore, bending may satisfy the allowable bending radius at room temperature of the sheet material at the middle stage of coiling. In this case, the temperature of the above described sheet material may be controlled from the coiling start place to the middle and, thereafter, coiling may be performed at room temperature without control. For example, temperature control may be applied to only the place grasped by the chuck portion. Alternatively, temperature control may be applied throughout the length from the coiling start place to the coiling finish place. In the case where coiling is performed while the temperature is controlled throughout the length, the sheet material can be coiled in the state in which the elongation of the sheet material is sufficiently large regardless of the size of the bending radius. Therefore, an occurrence of cracking and the like can be suppressed more effectively. In the case where the temperature is controlled throughout the length, the control temperature from the coiling start place to the middle and the control temperature from the middle and afterward may be differentiated, or be the same control temperature throughout the length.

(Coiler)

In particular, in the case where the coiling start place of the above described sheet material is heated, the following coiler according to the present invention is suitable for use. The coiler according to the present invention is a coil material coiler to coil the sheet material continuously produced by the continuous casting machine into the shape of a cylinder, and is provided with a chuck portion to grasp an end portion of the above described sheet material and a heating device to heat the region grasped by the above described chuck portion in the above described sheet material. Even in the case where bending with a minimum bending radius is applied by the above described chuck portion to the sheet material formed from a magnesium alloy, the region grasped by the chuck portion in the above described sheet material, that is, the coiling start place, can be heated easily. The heating device is disposed in such a way that this coiling start place is grasped by the chuck portion after being heated sufficiently. It is believed that an electric heater is used easily as this heating device. In this regard, it is preferable to use sliding contacts or the like because the wiring of the heating device may be twisted by a rotation of a winding drum. Heating by a heating device provided in the coiler and heating by a heating device disposed between the continuous casting machine and the coiler may be used in combination.

(Method for Manufacturing Magnesium Alloy Sheet)

The cast coil material obtained by the above described manufacturing method according to the present invention has an excellent surface texture, as described above. Therefore, for example, the above described cast coil material is prepared and the magnesium alloy sheet can be produced by using the part constituting t×90% or more of the thickness t of the above described cast coil material. More specifically, this magnesium alloy sheet can be produced by appropriate cutting and the like substantially without a treatment, e.g., polishing, or after performing a simple polishing treatment in which the amount of removal due to polishing can be made small. As described above, by using the cast coil material according to the present invention, a magnesium alloy sheet having an excellent surface texture can be produced with high productivity. The resulting magnesium alloy sheet has the same level of the thickness and the same level of strength and toughness as those of the cast coil material serving as the raw material.

Alternatively, the above described cast coil material is prepared, the above described cast coil material is subjected to rolling with a reduction ratio of 20% or less, so that the magnesium alloy sheet according to the present invention can be produced. As for such rolling with a low degree of forming, the above described cast coil material can be subjected to rolling on an as-is basis without being subjected to a heat treatment or the like in advance. The resulting magnesium alloy sheet has undergone plastic hardening and has strength still higher than that of the cast coil material. Therefore, a stronger magnesium alloy sheet can be produced with high productivity by using the cast coil material according to the present invention. Regarding both the above described rolling and rolling with a high degree of forming, as described later, cracking and the like do not occur easily when they are performed after the raw material is heated to 300° C. or lower, and in particular 150° C. or higher and 280° C. or lower. In this regard, the reduction ratio is a value represented by $\{(t_0-t_1)/t_0\}\times100$, where the thickness of the raw material before rolling is represented by $t_0$ and the thickness of the rolled sheet after rolling is represented by $t_1$, and refers to a total reduction ratio in the present specification.

Alternatively, the magnesium alloy sheet according to the present invention can be produced by preparing the above described cast coil material and applying a heat treatment at a heat treatment temperature Tan (K) satisfying $Tan \geq Ts\times0.75$ for a holding time of 30 minutes or more, where the solidus temperature of the magnesium alloy constituting the cast coil material is represented by Ts (K) and the heat treatment temperature is represented by Tan (K). It is preferable that the heat treatment temperature: Tan satisfies $Ts\times0.80K$ or more and $Ts\times0.90K$ or less because a magnesium alloy sheet exhibiting excellent toughness is obtained. The holding time is preferably 1 hour to 20 hours and a longer holding time is preferable as the content of additive elements becomes larger. This heat treatment typically corresponds to a solution treatment, the composition is homogenized and, in addition, the toughness is enhanced by second formation of solid solution of precipitates. Furthermore, by employing the above described specific heating temperature, a concentrated phase of additive elements can be diffused to some extent at interfaces of crystals constituting the cast organization by a heat treatment for even a short time of about 30 minutes and an effect of improving the toughness is obtained because of this diffusion effect. Therefore, a magnesium alloy sheet exhibiting more excellent toughness can be produced with high productivity by performing the above described specific heat treatment. In this regard, it is preferable to increase the cooling rate by using, for example, forced cooling, e.g., water cooling and an air blast, in a step of cooling after the above described holding time because precipitation of coarse precipitates can be suppressed.

Regarding the sheet subjected to the above described heat treatment, the toughness is enhanced, so that, for example, rolling with a larger reduction ratio (total reduction ratio) can be applied. That is, by applying rolling with a reduction ratio of 20% or more after the above described heat treatment, a magnesium alloy sheet exhibiting higher strength can be produced with high productivity. The reduction ratio can be selected appropriately. Application of a plurality of times of (multi-pass) rolling can produce a thinner sheet and, in addition, an average crystal grain size of the sheet is made small and the plastic formability, e.g., press forming, can be enhanced.

In the case where multi-pass rolling is performed, if an intermediate heat treatment is performed between passes to remove or reduce the strain, the residual stress, an aggregation structure, and the like introduced into the raw material through plastic forming (mainly rolling) up to this intermediate heat treatment, unprepared cracking, strain, and deformation in rolling thereafter are prevented and rolling can be performed more smoothly. As for the intermediate heat treatment, for example, a heating temperature of 150° C. to 350° C. and a holding time of 0.5 hours to 3 hours are mentioned.

Application of a final heat treatment (final annealing) or application of warm straightening to the above described sheet (rolled sheet) subjected to rolling enhances plastic formability, e.g., press forming, and is preferable in the case where the sheet is used as the raw material to be subjected to the above described plastic forming Moreover, a heat treatment is applied after the above described plastic forming and, thereby a strain and a residual stress introduced through plastic forming can be removed and the mechanical characteristics can be improved. In addition, it is possible to perform polishing, a corrosion protection treatment, painting, and the like after the above described rolling, after the above described final heat treatment, after the warm straightening, after the above described plastic forming, or after the heat treatment following the above described plastic forming, so as to further improve the corrosion resistance, ensure mechanical protection, and enhance a commercial value.

TEST EXAMPLE 1-1

Cast coil materials were produced by heating magnesium alloy cast materials having various thicknesses to various temperatures during coiling and performing coiling with various sizes of bending radii. Then, the surface states of the resulting cast coil materials were examined As for this test, a molten metal of a magnesium alloy was prepared, as shown in FIG. 1A, continuous casting was performed with a continuous casting machine 110, a sheet material 1 having a thickness t shown in Table II was produced by adjusting the distance between a pair of rolls serving as a mold, the sheet material 1 was coiled into the shape of a cylinder with a coiler 120 disposed downstream from the continuous casting machine 110, so as to form a cast coil material. Here, magnesium alloys having a composition (Mg-9.0% Al-1.0% Zn, formula value $D\geq14.5$ is satisfied) corresponding to the AZ91D alloy on the basis of the American Society for Testing Materials Standard, a composition (Mg-3.0% Al-1.0% Zn) corresponding to the AZ31B alloy, a composition (Mg-4.0% Al-1.6% Si) corresponding to the AS42 alloy, and a composition (Mg-5.0% Al-1.7% Ca) corresponding to the AX52 alloy were prepared (all the additive materials were in percent by mass). In this regard, each alloy having any thickness t was prepared in such a way that a sheet material having a whole length of 50 m was able to be produced. Furthermore, a twin-roll casting machine was used here as the continuous casting machine 110.

The continuous casting machine 110 has a water-cooled movable mold (roll) and can quench and solidify a molten metal. A pair of rolls are rotated by a rotation mechanism, although not shown in the drawing. The coiler 120 includes a winding drum 121 and a rotation mechanism (not shown in the drawing) to rotate the winding drum 121, the continuously cast sheet material 1 is moved to the coiler 120 side by the rotation of the winding drum 121, and finally the sheet material 1 is coiled.

In this test, the time of contact of the molten metal with the roll was adjusted and, in addition, the cooling temperature of the roll was adjusted in such a way that the temperature of the range A from a discharge port of the continuous casting machine 110 up to 150 mm in the moving direction of the sheet material 1 became 140° C. to 150° C. That is, the sheet material 1 was cooled through natural standing to cool. Then, a heating device 130 was disposed in such a way that the sheet material 1 between the point at which the sheet material 1 was cooled to 150° C. or lower (the point at a distance of 150 mm from the discharge port) and coiling with the coiler 120 was able to be heated, and the sheet material 1 was heated to reach the temperature shown in Table II (here, 100° C., 120° C., 150° C., and 200° C.). In this regard, as for the heating device 130, a commercially available electric heater was used. Regarding the above described heating temperature, the temperature of the sheet material 1 was measured with thermometers (not shown in the drawing) during heating and just after heating, and the heating device 130 was adjusted in such a way that the sheet material 1 came into the range of not being burned nor oxidized. In addition, the surface temperature of the sheet material 1 just before being coiled by the coiler 120 was measured with a thermometer 125 and the heating device 130 was adjusted in such a way that the measured temperature became the temperature shown in Table II. As for the thermometer 125, a commercially available non-contact type thermometer was used.

Meanwhile, as for the winding drum 121 of the coiler 120 in this test, winding drums having various radii were prepared. The sheet material 1 was coiled, where the radius of the winding drum was taken as the minimum bending radius Rmin, and possibility of coiling and the surface state of the coiled cast coil material were examined. The results thereof are shown in Table II and FIG. 2. In Table II and FIG. 2, a symbol x indicates that the sheet material was not able to be coiled because of breakage or large amounts of cracks, a symbol Δ indicates that coiling was possible, but cracks were observed in a part of the surface, and a symbol ○ indicates that coiling was possible and there was substantially no crack throughout the length. Presence or absence of crack was visually examined.

Furthermore, in this test, a stainless steel thin sheet was connected to the end edge portion of the coiling start place of the sheet material 1, and this thin sheet serving as a lead sheet was coiled on the coiler 120, so that bending of the coiling start place was made larger than the minimum bending radius Rmin shown in Table II.

TABLE II

| Thickness t (mm) | Alloy species (ASTM Standard) | Minimum bending radius Rmin (mm) | Surface strain t/Rmin | Heating temperature T (° C.) 100 | 120 | 150 | 200 |
|---|---|---|---|---|---|---|---|
| 4.5 | AZ91D | 300 | 0.015 | X | X | Δ | ○ |
| | AZ91D | 400 | 0.01125 | Δ | Δ | ○ | ○ |
| | AZ91D | 500 | 0.009 | Δ | ○ | ○ | ○ |
| | AZ91D | 600 | 0.0075 | ○ | ○ | ○ | ○ |
| 4 | AZ91D | 300 | 0.013333 | Δ | Δ | ○ | ○ |
| | AZ91D | 400 | 0.01 | Δ | Δ | ○ | ○ |
| | AZ31B | 500 | 0.008 | ○ | ○ | ○ | ○ |
| | AZ91D | 500 | 0.008 | Δ | ○ | ○ | ○ |
| | AS42 | 500 | 0.008 | Δ | ○ | ○ | ○ |

TABLE II-continued

| Thickness t (mm) | Alloy species (ASTM Standard) | Minimum bending radius Rmin (mm) | Surface strain t/Rmin | Heating temperature T (° C.) 100 | 120 | 150 | 200 |
|---|---|---|---|---|---|---|---|
| | AX52 | 500 | 0.008 | Δ | ○ | ○ | ○ |
| | AZ91D | 600 | 0.006667 | ○ | ○ | ○ | ○ |
| | AS42 | 600 | 0.006667 | ○ | ○ | ○ | ○ |
| | AX52 | 600 | 0.006667 | ○ | ○ | ○ | ○ |
| 3.5 | AZ91D | 300 | 0.011667 | Δ | Δ | ○ | ○ |
| | AZ91D | 400 | 0.00875 | Δ | ○ | ○ | ○ |
| | AZ91D | 500 | 0.007 | ○ | ○ | ○ | ○ |
| | AZ91D | 600 | 0.005833 | ○ | ○ | ○ | ○ |

Figure 2:
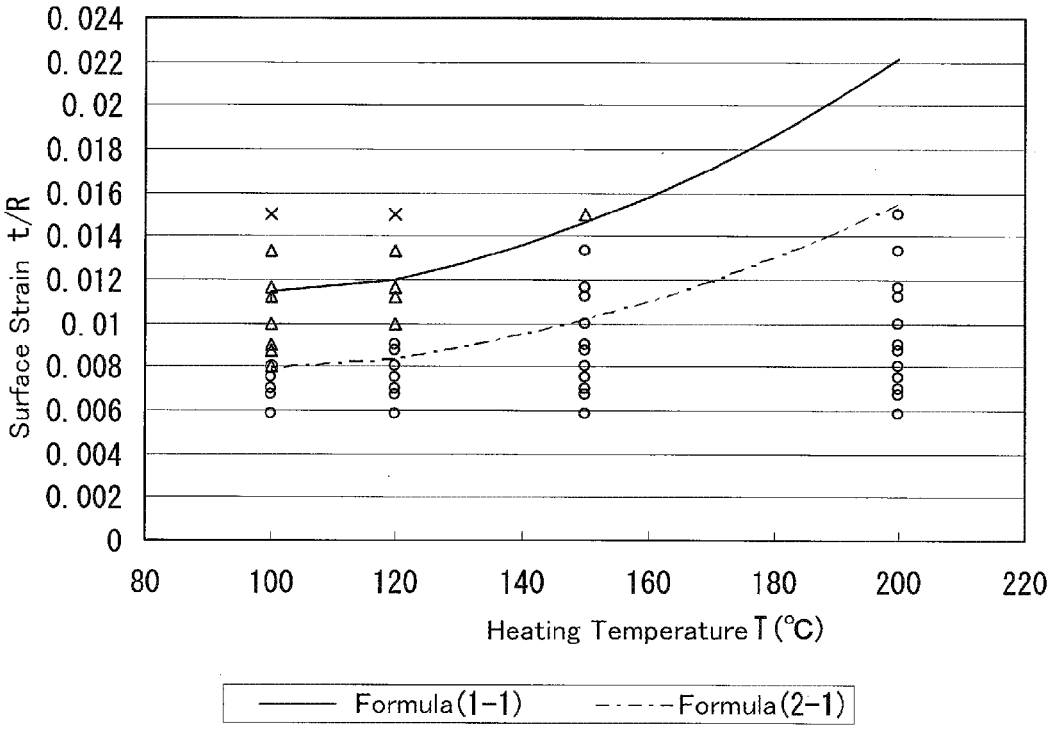
[FIG. 2]

As is clear from Table II and FIG. 2, in the case where the surface strain t/Rmin is small, bending can be performed sufficiently even when the heating temperature is low. In particular, it is clear that preferably, the heating temperature T is 150° C. or higher as for the surface strain t/Rmin>0.01, 120° C. or higher as for 0.008≤t/Rmin≤0.01, and 100° C. or higher as for t/Rmin<0.008.

Regarding the magnesium alloy cast coil material indicated by the symbol ○ in Table II, a tensile test (gauge length GL: 30 mm) was performed on the basis of the specification of JIS Z 2241 (1998), so that the tensile strength and the elongation were examined at room temperature. As a result, regarding every sample subjected to the tensile test, the tensile strength was 251 MPa to 317 MPa, that is, 250 MPa or more, and the elongation was 0.5% to 8.1%, that is, 10% or less.

As is clear from Table II and FIG. 2, as the heating temperature T was raised, cracking and the like did not occur, and a cast coil material having an excellent surface texture was produced. Then, the temperature was further raised and, as a result, discoloration of the surface was significant when 350° C. was exceeded. Consequently, it can be said that the heating temperature T is preferably 350° C. or lower.

TEST EXAMPLE 1-2

Figure 3:
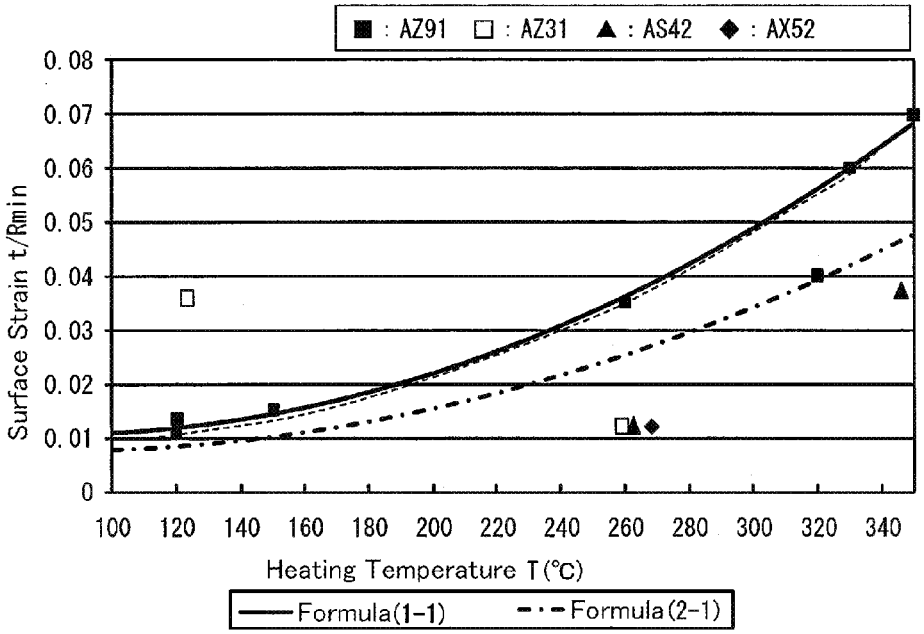
[FIG. 3]

Regarding production of the cast coil material as in Test example 1-1, the heating temperature at which coiling was able to be performed without an occurrence of cracking was examined in the case where the surface strain was large. The results thereof are shown in Table III and FIG. 3.

In this test, the same magnesium alloys as those in Test example 1-1 (those having compositions corresponding to the AZ91D, the AZ31B, the AS42, and the AX52 alloys specified in the American Society for Testing Materials Standard) were prepared. Regarding the case where the surface strain t/Rmin>0.01, as shown in Table III, the heating temperature at which coiling was able to be performed without an occurrence of cracking was measured as in Test example 1-1. Furthermore, regarding the magnesium alloy cast coil material, the tensile strength and the elongation at room temperature obtained as in Test example 1-1 were examined. The results thereof are also shown in Table III.

Figure 4A:
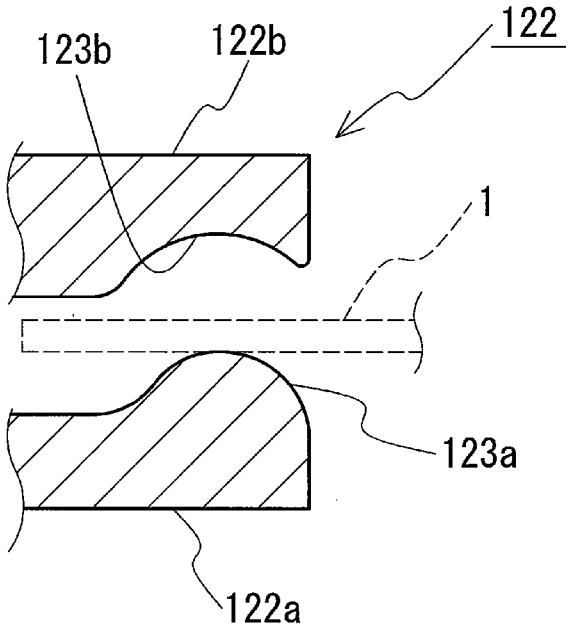
[FIG. 4A]

In this test, in the case where the minimum bending radius Rmin was small, bending applied by a chuck portion provided in a coiler was assumed rather than the radius of a winding drum of the coiler. FIG. 4A shows an example of the chuck portion. A chuck portion 122 has a pair of grasping pieces 122*a* and 122*b* holding the coiling start place of the sheet material 1. One grasping piece 122*a* has a convex portion 123*a* and the other grasping piece 122*b* has a concave portion

Figure 4B:
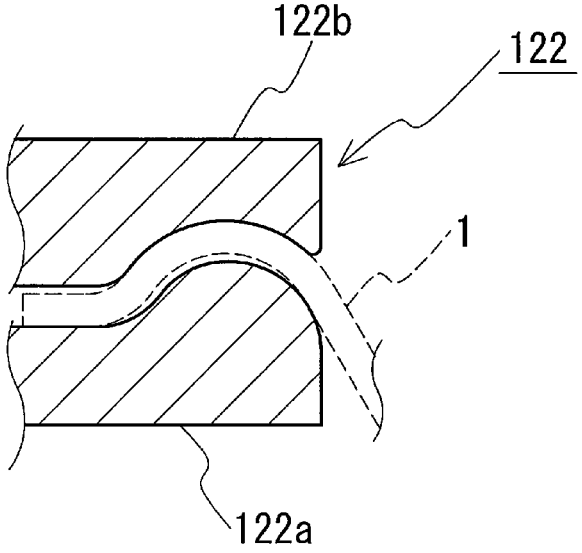
[FIG. 4B]

123*b* fitted to the convex portion 123*a*. The sheet material 1 is inserted between the convex portion 123*a* and the concave portion 123*b*, the convex portion 123*a* and the concave portion 123*b* are engaged, a predetermined pressure is applied and, thereby, bending along the convex portion 123*a* and the concave portion 123*b* is applied to the sheet material 1, so that the sheet material 1 is held between the convex portion 123*a* and the concave portion 123*b* firmly. Consequently, as shown in FIG. 4B, bending nearly along the shapes of the convex portion 123*a* and the concave portion 123*b* is applied to the sheet material 1.

Figure 1B:
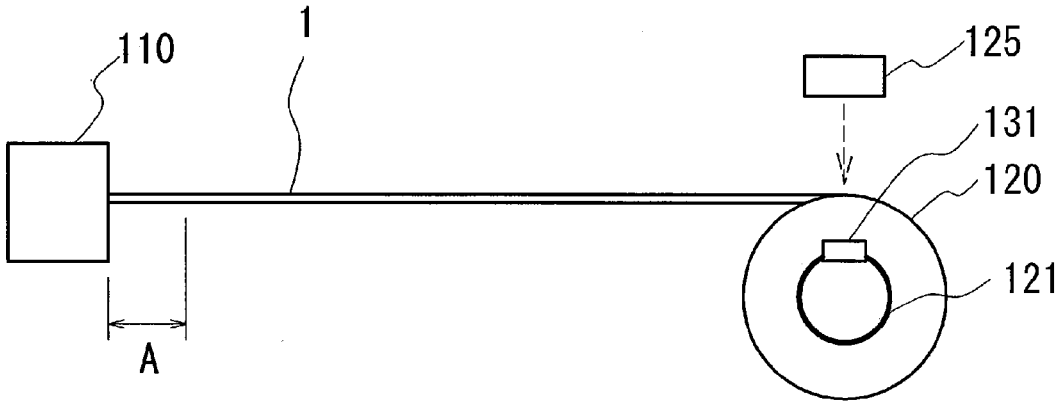
[FIG. 1B]

Then, in this test, as shown in FIG. 1B, in order that the region, in which the sheet material 1 was grasped by the chuck portion (not shown in the drawing), was able to be heated on the winding drum 121 of the coiler 120, the winding drum 121 provided with a heating device 131 to heat the above described region was included in the coiler 120 used. Subsequently, as in Test example 1-1, the surface temperature of the sheet material 1 just before coiling by the coiler 120 was measured with the thermometer 125, and a heating temperature at which the region grasped by the chuck portion (coiling start place) of the sheet material 1 was able to be coiled without breakage was measured. In this regard, in this test, the radius of the winding drum was specified to be 600 mm.

TABLE III

| Sample No. | Alloy species (ASTM Standard) | Surface strain t/Rmin | Thickness t (mm) | Minimum bending radius Rmin (mm) | Heating temperature T (° C.) | Tensile strength (MPa) | Elongation (%) |
|---|---|---|---|---|---|---|---|
| 2-1 | AZ91D | 0.011667 | 3.5 | 300 | 120 | 325 | 6.3 |
| 2-2 | AZ91D | 0.013333 | 4 | 300 | 120 | 315 | 7.3 |
| 2-3 | AZ91D | 0.015 | 4.5 | 300 | 150 | 309 | 6.8 |
| 2-4 | AZ91D | 0.035 | 7 | 200 | 260 | 285 | 2.5 |
| 2-5 | AZ91D | 0.04 | 4 | 100 | 320 | 301 | 8.2 |
| 2-6 | AZ91D | 0.06 | 6 | 100 | 330 | 299 | 8.5 |
| 2-7 | AZ91D | 0.07 | 7 | 100 | 350 | 302 | 8.3 |
| 2-8 | AZ31B | 0.035 | 7 | 300 | 120 | 225 | 3.3 |
| 2-9 | AZ31B | 0.013333 | 4 | 300 | 260 | 235 | 9.7 |
| 2-10 | AS42 | 0.013333 | 4 | 300 | 125 | 263 | 5.0 |
| 2-11 | AS42 | 0.013333 | 4 | 300 | 260 | 272 | 4.3 |
| 2-12 | AS42 | 0.035 | 7 | 300 | 345 | 270 | 3.8 |
| 2-13 | AX52 | 0.013333 | 4 | 300 | 120 | 282 | 5.9 |
| 2-14 | AX52 | 0.013333 | 4 | 300 | 260 | 279 | 5.6 |

The relationship between the surface strain t/Rmin and the heating temperature T was studied from the obtained data. Regarding the experimental data shown in FIG. 3, samples excluding Sample Nos. 2-5, 2-8, 2-9, 2-11, 2-12, and 2-14, which took on peculiar values, were used and an approximate equation of the relationship between the surface strain t/Rmin and the heating temperature T was considered. In the range of the t/Rmin of less than 0.1, as indicated by a broken line shown in FIG. 3, the t/Rmin was able to be interpreted as a quadratic function, where a variable was T. Therefore, a and b were taken as coefficients, and a and b satisfying a quadratic equation, $t/Rmin=a\times T^2+b$ were determined. Here, a and b were calculated on the basis of primary approximate equation of t/Rmin and $T^2$ by using a commercially available statistical analysis software "Excel Toukei (Excel Statistics)". As a result, the following Formula (1-1) was obtained.

Furthermore, the numerator of this Formula (1-1) was fixed, and an equation along Sample No. 2-5 was determined by the above described software. As a result, the following Formula (2-1) was obtained. In consideration of these Formula (1-1), Formula (2-1), and the results of Test example 1-1, it can be said that the heating temperature T preferably satisfies Formula (1-1) described above, and more preferably satisfies Formula (2-1) described above.

[Equation 2]

$$\frac{\frac{(T-80)^2}{450}+30}{2800}=\frac{t}{R\min} \quad \text{Formula (1-1)}$$

$$\frac{\frac{(T-80)^2}{450}+30}{4000}=\frac{t}{R\min} \quad \text{Formula (2-1)}$$

Moreover, Formula (1-1) and Formula (2-1) were superposed on the graph shown in FIG. 2 of the experimental data determined in Test example 1-1. As a result, it can be said that regarding the range of t/Rmin≤0.01 as well, the heating temperature T preferably satisfies Formula (1-1) described above, and more preferably satisfies Formula (2-1) described above.

TEST EXAMPLE 1-3

A magnesium alloy sheet was produced by using the magnesium alloy cast coil material obtained in Test example 1-1.

In this test, the cast coil material which was produced in the Test example 1-1 and which had the thickness t: 4 mm, the minimum bending radius Rmin: 500 mm, and the heating temperature: 150° C. was prepared as a raw material. Magnesium alloy sheets were produced by applying rolling with various reduction ratios (5% to 30%), and possibility of rolling and the surface texture of the resulting magnesium alloy sheet were examined The results thereof are shown in Table IV. The surface state was examined visually or by using a stereomicroscope, and in the case where judgment was difficult, the surface state was examined by color check (a method in which determination was performed through coloration by using a visible dye penetrant). Regarding "crack" of the surface state shown in Table IV, a symbol×indicates that cracks occurred to a great extent, a symbol A indicates that fine cracks were observed to some extent, and a symbol ○ indicates that substantially no crack occurred. Regarding "discoloration" of the surface state shown in Table IV, a symbol ○ indicates the case where the appearance had a gloss, a symbol A indicates the case where the appearance had no gloss, and a symbol×indicates the case where the appearance had no gloss and as a result of observation of a cross-section with a microscope, an oxide film having a maximum thickness of more than 1 μm was generated. In this regard, when a cross-section of the sample having a glossy appearance was observed with a microscope, the maximum thickness of an oxide film was 1 μm or less.

In this test, as shown in Table IV, a part of samples were subjected to the heat treatment shown in Table IV before rolling and, thereafter, rolling was performed. In this regard, rolling of every sample was performed while the heating temperature of the raw material sheet was specified to be 250° C. to 280° C. and the roll temperature was specified to be 100° C. to 250° C. Meanwhile, regarding Sample No. 3-15, a dent having a depth of less than 0.1 mm was generated in the surface of the cast material before coiling. This cast material was coiled after the temperature was raised, as described above, and the surface after coiling was examined As a result, the size of the dent was not changed between before and after coiling. Therefore, Sample No. 3-15 was subjected to belt polishing before rolling, so as to remove a surface layer portion and, thereby, remove the above described dent. Here, the surface layer portion having a thickness of 0.15 mm of each of the front and the back surfaces of the cast material, that is, 0.3 mm in total of surface layer portion was removed. The thickness of the resulting magnesium alloy sheet was 3.7 mm and, therefore, satisfies 90% or more of the thickness of the magnesium alloy cast coil material of 4 mm.

TABLE IV

| Sample No. | Alloy species (ASTM Standard) | Cutting of front and back surfaces | Heat treatment condition | Reduction ratio (%) | Surface state | |
|---|---|---|---|---|---|---|
| | | | | | Crack | Discoloration |
| 3-1 | AZ91D | none | none | 5 | ○ | ○ |
| 3-2 | AZ91D | none | none | 10 | ○ | ○ |
| 3-3 | AZ91D | none | none | 20 | X | ○ |
| 3-4 | AZ91D | none | 300° C. × 24 hours | 20 | Δ | ○ |
| 3-5 | AZ91D | none | 350° C. × 24 hours | 20 | ○ | X |
| 3-6 | AZ91D | none | 350° C. × 0.45 hours | 20 | X | ○ |
| 3-7 | AZ91D | none | 350° C. × 0.5 hours | 25 | ○ | ○ |
| 3-8 | AZ91D | none | 320° C. × 24 hours | 35 | ○ | ○ |
| 3-9 | AZ91D | none | 350° C. × 24 hours | 35 | ○ | X |
| 3-10 | AZ91D | none | 405° C. × 2 hours | 35 | ○ | X |
| 3-11 | AS42 | none | none | 20 | X | ○ |
| 3-12 | AS42 | none | 350° C. × 24 hours | 20 | ○ | X |
| 3-13 | AX52 | none | none | 20 | X | ○ |
| 3-14 | AX52 | none | 350° C. × 24 hours | 20 | ○ | X |
| 3-15 | AZ91D | total 0.3 mm | 320° C. × 24 hours | 35 | ○ | ○ |

As is clear from Table IV, in the case where the above described cast coil material is subjected to rolling with a reduction ratio of less than 20%, the cast coil material can be used as a raw material on an as-is basis without being subjected to a heat treatment or the like. On the other hand, it is clear that in the case where rolling with a reduction ratio of 20% or more is applied, preferably, a heat treatment is applied before rolling. In particular, it can be said that this heat treatment satisfies $Tan \geq Ts \times 0.8 \approx 594$ K$\approx$321° C., where the solidus temperature of the magnesium alloy constituting the above described cast coil material is represented by Ts (K) (about 743 K$\approx$470° C. as for AZ91D) and the heat treatment temperature is represented by Tan (K), the holding time is preferably 30 minutes or more (0.5 hours or more), and more preferably, $Tan \leq Ts \times 0.9 \approx 669$ K$\approx$396° C. is satisfied.

Furthermore, the tensile strength of the magnesium alloy sheet including no crack or the like was measured and, as a result, the strength was still higher than the strength of the above described cast coil material. Moreover, the rolled material of Sample No. 3-15 which had been rolled after the surface was polished, as described above, had nearly the same characteristics as those of the rolled material of Sample No. 3-8. Consequently, it was ascertained that the magnesium alloy sheet (here, rolled material) having a thickness of t×90% or more relative to the thickness t of the above described cast coil material was produced by coiling the cast material in the state of having a sufficient elongation because of heating.

TEST EXAMPLE 1-4

Next, a test example in which a sheet material after casting was coiled without performing heating between a continuous casting machine and a coiler will be described. In the present example, casting was performed in such a way that the temperature of the sheet material just after being discharged from the continuous casting machine became 200° C., and coiling of the sheet material was performed while the whole length of the sheet material until the sheet material was introduced into the coiler was surrounded by a heat insulating material. In the present example, a molten metal formed from a magnesium alloy having a composition corresponding to the AZ91D was cast through twin-roll casting, and the resulting sheet material having a thickness of 4 mm and a width of 250 mm was taken as a sample. The temperature of the sheet material just before rolling was 150° C. As a result, it was ascertained that coiling was possible without an occurrence of cracking in the sheet material even when the minimum bending radius Rmin was 300 mm. Furthermore, the test was performed with respect to a sheet material having a high heat dissipation effect because of a smaller thickness and a large specific surface area. As a result, a sheet material having a thickness of 3 mm and a width of 250 mm was heat insulated in such a way that the temperature just before coiling became 150° C. and was coiled. Consequently, it was ascertained that coiling was possible without an occurrence of cracking in the sheet material even when the minimum bending radius Rmin was 200 mm.

EXAMPLE 2-1

Next, a method for manufacturing a magnesium alloy cast coil material, the method being suitable for use in casting and coiling of sheet materials in Example 1-1 described above and other examples described later, as a matter of course, and being widely applicable to production of magnesium alloy cast coil materials regardless of the presence or absence of the conditions specified in these examples, and a magnesium alloy cast coil material obtained by the method will be described. According to this technology, a magnesium alloy cast coil material coiled tightly in such a way that gaps are not formed between individual turns of the coil material easily can be obtained.

The present inventors produced the magnesium alloy cast coil material by coiling the cast material of the magnesium alloy actually. As a result, it was made clear that not only the quality of the cast material in itself, but also the shape and the form were important for the coil material in the case where the magnesium alloy cast coil material produced by coiling the cast material was subjected to secondary forming, e.g., rolling and polishing.

In the case where the magnesium alloy cast material having poor formability at ambient temperature to relatively low temperatures is coiled, gaps are formed easily between turns of the coil material because of a reaction force of the cast material with respect to bending in coiling. If gaps are present between turns, for example, when the coil material is uncoiled and subjected to secondary forming, e.g., rolling, problems may occur in that, for example, the uncoiled cast material is moved from side to side, so as to degrade the quality of fabricated articles.

Furthermore, if gaps are present between turns of the coil material, for example, when the coil material is subjected to a treatment to form a solid solution and is water-cooled, the cooling water enters into the gaps, so that partial corrosion or discoloration may occur in the coil material.

In consideration of the above described problems, the inventors of the present invention performed various studies. As a result, it was found that in production of the magnesium alloy cast coil material, gaps were not formed easily between turns of the resulting magnesium alloy cast coil material by controlling the temperature distribution in the width direction of the cast material just before coiling and the coiling tension in appropriate ranges. The following magnesium alloy cast coil material and the method for manufacturing the same are specified on the basis of the above described findings.

[Magnesium Alloy Cast Coil Material]

This magnesium alloy cast coil material is formed by coiling long lengths of magnesium alloy cast material, and the maximum distance, which is represented by d, among distances from a straight line circumscribing both end surfaces of the coil-shaped cast material to the perimeter surface of the coil-shaped cast material and the width, which is represented by w, satisfy $0.0001\ w<d<0.01\ w$. Moreover, the perimeter surface of the coil-shaped cast material is located in the side nearer to a core portion of the coil-shaped cast material than is the above described straight line.

This magnesium alloy cast coil material is in the shape of a Japanese hand drum in which the intermediate portion in the width direction thereof is dented, and is a magnesium alloy cast coil material in which the dent is specified to be within the above described range. As a result of research of the present inventors, it was made clear that in the case where the dent in the intermediate portion in the width direction of the magnesium alloy cast coil material was in the above described range, the coil material was coiled tightly and gaps formed between turns of the coil material were very small. Consequently, when a sheet cast material produced by uncoiling the magnesium alloy cast coil material is subjected to secondary forming, the cast material can be fed to the secondary forming step stably and, thereby, fabricated articles having excellent quantity can be produced. Furthermore, when this magnesium alloy cast coil material is subjected to a treatment to form a solid solution and is water-cooled thereafter, the cooling water does not enter the gaps between turns of the coil material easily, so that partial corrosion of the magnesium alloy cast coil material resulting from the cooling water can be suppressed.

Moreover, according to the magnesium alloy cast coil material in the shape of a Japanese hand drum in which the intermediate portion in the width direction is dented, a steel band for preventing uncoiling of the coil does not easily come off the coil material and, therefore, the coil material is handled very easily when being subjected to secondary forming or being shipped to a customer.

The configuration of this magnesium alloy cast coil material will be described below in detail.

The gap between turns in the magnesium alloy cast coil material is preferably 1 mm or less. A small gap between the turns refers to high flatness of the cast material constituting the coil material (that is, there are small variations in thickness of the cast material). Consequently, in the case where a cast material produced by uncoiling this coil material is subjected to secondary forming, fabricated articles having excellent quantity can be produced. A preferable value of the gap is 0.5 mm or less.

Meanwhile, it is preferable that variations in sheet thickness of the cast material constituting this magnesium alloy cast coil material are ±0.2 mm or less. Variations in sheet thickness may be determined on the basis of, for example, measurement results of at least 10 points at predetermined intervals (for example, every 10 m) in the longitudinal direction of the cast material. In this regard, with respect to the individual measurement points in the longitudinal direction, it is preferable that an average of the results of sheet thickness measurement of at least three points, that is, both edge portions in the width direction of the cast material and an intermediate portion, is determined For example, a center sensor to measure the thickness of the intermediate portion in the width direction of the cast material and a pair of side sensors to measure the respective thicknesses of both edge portions in the width direction of the cast material are disposed on a straight line in the width direction and, thereby, thicknesses of three places in the width direction every 10 m of the cast material are measured and averaged. Then the resulting average thicknesses every 10 m of the cast material are compared and it is enough that variations in sheet thickness are ±0.2 mm or less. Here, the variations in sheet thickness in the width direction of the cast material are preferably ±0.05 mm or less. In this regard, the thickness in the vicinity of the side edge portion of the cast material is not stable and, therefore, the position of measurement with the side sensor is specified to be 20 mm or more inside from the side edge of the cast material.

Small fluctuation in sheet thickness of the cast material of the coil material is synonymous with small unevenness of the cast material and, therefore, it can be said that the flatness of the cast material of the coil material is high. That is, it can be said that regarding the magnesium alloy cast coil material formed by tightly coiling the cast material with small fluctuation in sheet thickness, gaps formed between individual turns are very small.

As for the cast material constituting this magnesium alloy cast coil material, the same composition, mechanical characteristics, and forms as those of the sheet material in Example 1-1 can be used.

[Method for Manufacturing Magnesium Alloy Cast Coil Material]

The above described magnesium alloy cast coil material can be produced by a method for manufacturing a magnesium alloy cast coil material described below.

This method for manufacturing a magnesium alloy cast coil material satisfies the following conditions in a process to continuously produce a sheet cast material formed from a magnesium alloy with a continuous casting machine and produce a magnesium alloy cast coil material by coiling the resulting sheet cast material into the shape of a cylinder.

Variations in temperature in the width direction of the cast material just before coiling is specified to be within 50° C. and the temperature of the cast material is controlled in such a way that the temperature of the intermediate portion in the width direction of the cast material becomes higher than the temperature of both edge portions.

The cast material is coiled by applying a coiling tension of 300 kgf/cm$^2$ or more.

In this regard, it is preferable that the temperatures of both edge portions in the width direction of the cast material are the measurement results at positions 20 mm or more from the side edge of the cast material toward the intermediate portion in the width direction. This is because fluctuation in temperature of the side edge of the cast material is large.

In the case where the temperature of the intermediate portion in the width direction of the cast material to be coiled is specified to be a temperature higher than the temperature of both edge portions in the same width direction, the above described both edge portions are cooled easily prior to the intermediate portion, and the resulting magnesium alloy cast coil material tends to take on the shape of a Japanese hand drum in which the intermediate portion in the width direction thereof is dented. Furthermore, in the case where a temperature difference is provided in the width direction of the cast material, the temperature difference is specified to be within 50° C. and, in addition, the coiling tension in coiling of the cast material is specified to be constant, 300 kgf/cm$^2$ or more, both edge portions of the coiled cast material are not warped excessively in the perimeter direction of the coil material and it is possible to tightly coil in such a way that gaps, which are heterogeneous in the width direction of the coil material, are not formed easily between turns of the resulting magnesium alloy cast coil material. The temperature difference is more preferably within 15° C.

Moreover, according to this method for manufacturing a magnesium alloy cast coil material, regarding even a magnesium alloy cast coil material formed by coiling 30 m or more of cast material, gaps are not formed easily between turns of the coil material. According to the manufacturing method concerned, 100 m or more of cast material can be coiled into the shape of a coil.

In order to control the temperature of the cast material just before coiling in this method for manufacturing a magnesium alloy cast coil material, approximately, at least one of the following three items may be performed.

The first item is to control the cooling temperature in production of the sheet cast material from the molten metal with the continuous casting machine. For example, in the case where the continuous casting machine is a twin-roll type continuous casting apparatus, control of the temperature of the casting roll and control of the casting speed and the temperature of the molten metal are mentioned.

The second item is to control natural cooling of the cast material from the continuous casting machine up to the coiler. For example, reduction of a section from the continuous casting machine to the coiler or enhancement of the hermeticity and the heat insulating property of the section are mentioned. Usually, both edge portion sides in the width direction of the cast material are cooled easily. Therefore, it is favorable to moderate cooling of both side edge portions.

The third item is to heat the cast material again before coiling with the coiler. Reheating can control the temperature in the width direction of the cast material easily. This reheating contributes to, for example, facilitation of coiling of the high-rigidity AZ91 alloy on the basis of the American Society for Testing Materials.

Meanwhile, the coiling tension in this method for manufacturing a magnesium alloy cast coil material may be selected appropriately in accordance with the cross-sectional area of the cast material, but it is preferable to set at a high level in general. For example, it is preferable that the coiling tension is specified to be constant, 450 kgf/cm$^2$ or more. However, if the coiling tension is too high, unexpected deformation of the cast material may be caused. Therefore, it is favorable that the coiling tension is specified to be 125 [kgf/(cm$^2$·cm$^2$)]×S (cm$^2$: cross-sectional area of cast material) or less.

As for one form of this method for manufacturing a magnesium alloy cast coil material, it is preferable that the temperature of the intermediate portion in the width direction of the cast material just before coiling and the temperatures of both edge portions are kept within the range of 150° C. to 350° C. In the case where the temperature of the cast material just before coiling is specified to be within the range of 150° C. to 350° C., the cast material is coiled easily regardless of the composition of the cast material. For example, even the cast material formed from the AZ91 alloy provided with high rigidity can be coiled without an occurrence of cracking and the like. Furthermore, the quality in the longitudinal direction of the coiled cast material can be stabilized by reducing variations in temperature in the longitudinal direction of the cast material.

As for one form of this method for manufacturing magnesium alloy cast coil material, it is also preferable that variations in temperature in the longitudinal direction of the cast material is specified to be within 50° C. In the case where variations in temperature of the cast material from start of coiling to finish of coiling are small, the coiling tension applied to the cast material can be stabilized during a coiling operation.

Moreover, as for one form of this method for manufacturing magnesium alloy cast coil material, it is preferable that the measurement of temperature of the cast material just before coiling is started from the position of 10 m of production from the coiling end (coiling start end) of the cast material. This is because the cast material up to 10 m from the coiling end exhibits poor stability in temperature, so that it is difficult to reduce variations in temperature of the cast material.

EXAMPLE 2-2

Figure 6A:
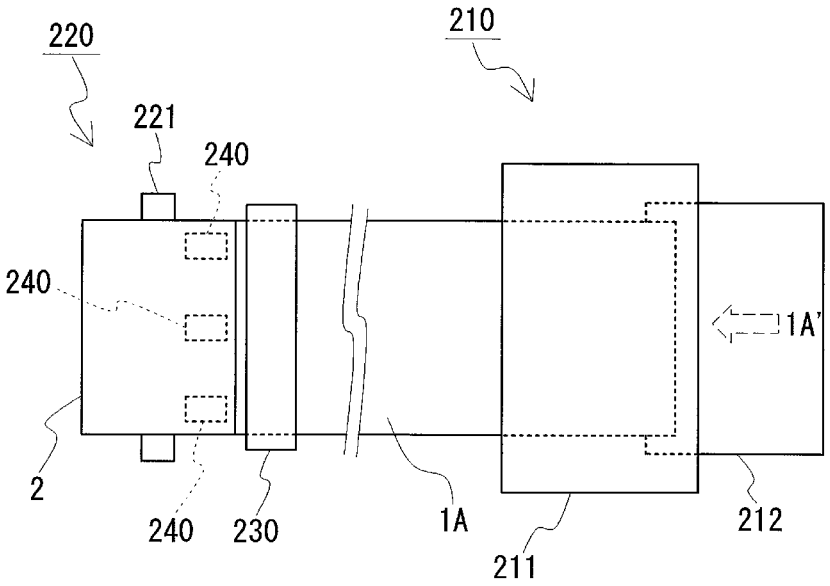
[FIG. 6A]
Figure 6B:
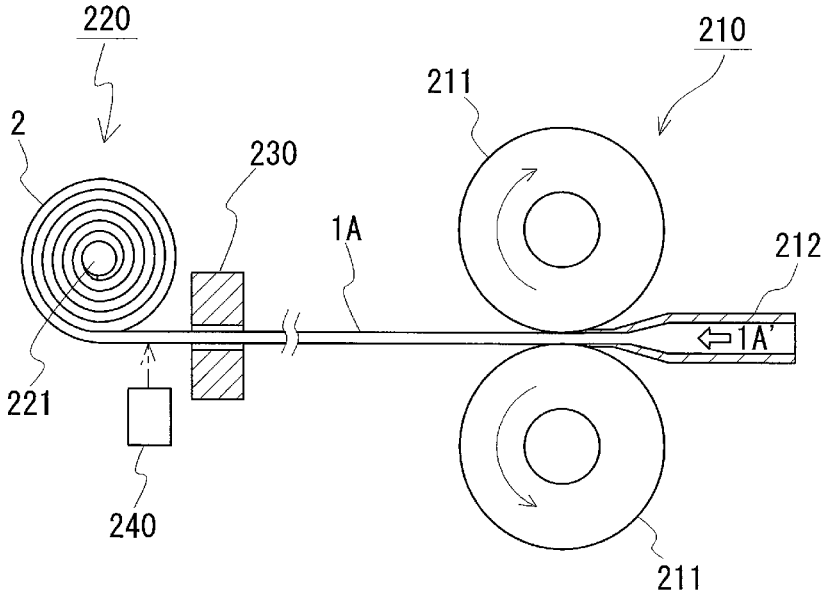
[FIG. 6B]
Figure 7:
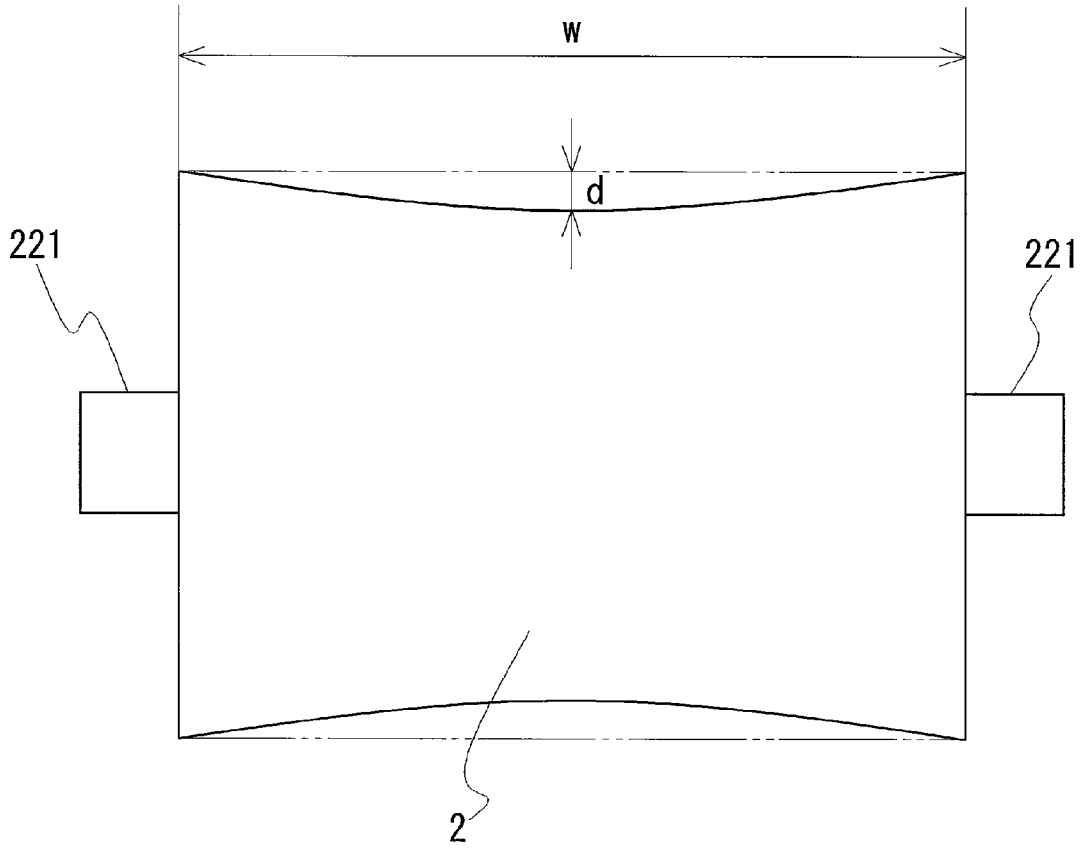
[FIG. 7]

Next, the magnesium alloy cast coil material in the shape of a Japanese hand drum and a method for manufacturing the same will be described in more detail with reference to FIG. 6A, FIG. 6B, and FIG. 7. This example can also be used in combination with other examples. Here, a cast material composed of a magnesium alloy is produced, and a magnesium alloy cast coil material is produced by coiling this cast material into the shape of a coil on the basis of the above described method for manufacturing a magnesium alloy cast coil material or a manufacturing method in the related art.

Initially, a molten metal 1A' of a magnesium alloy (Mg-9.0 percent by mass Al-1.0 percent by mass Zn) corresponding to the AZ91D alloy on the basis of the American Society for Testing Materials Standard was prepared. As shown in FIG. 6A and FIG. 6B, a sheet cast material 1A was produced by performing continuous casting with a twin-roll type continuous casting machine 210. The resulting cast material 1A was coiled into the shape of a cylinder with a coiler 220 disposed downstream from the casting machine 210, so as to become a magnesium alloy cast coil material 2.

The twin-roll type continuous casting machine 210 used in the present example is provided with one pair of water-cooling type casting rolls 211 and 211, and a casting nozzle 212 to feed the molten metal 1A' between the two rolls 211 and 211. According to this casting machine 210, the molten metal 1A' fed from the casting nozzle 212 is quenched and solidified with the water-cooling type casting rolls 211 and 211, so that the sheet cast material 1A including segregation to a small extent can be produced. In this regard, according to this casting machine 210, cast materials 1A having various thicknesses can be produced by controlling the interval between the two rolls 211 and 211.

The width of the resulting cast material 1A is regulated mainly by the width of a side dam of the casting nozzle 212 to insert into the casting rolls 211 and 211. Meanwhile, the sheet thickness of the cast material 1A is regulated mainly by controlling the space between opposite casting rolls 211 and 211 and rotation speed of the casting rolls 211 and 211 and controlling the tension applied to the cast material 1A through changing of the rotation speed of a winding drum 221 of the coiler 220. Variations in sheet thickness of the cast material 1A are affected by the rotation speed of the casting rolls 211 and 211, the shape, the temperature, and others, e.g., a tension applied to the cast material 1A. In the present example, variations in sheet thickness of the cast material 1A are reduced by controlling the rotation speed of the casting rolls 211 and 211 and a tension applied to the cast material 1A. In particular, regarding the sheet thickness and variations thereof, it is favorable that the stress applied by the casting rolls 211 and 211 to the cast material 1A is measured, and in accordance with the stress, the rotation speed of the casting rolls 211 and 211 and a tension applied to the cast material 1A are controlled to become almost constant during coiling of the cast material 1A.

Furthermore, in the production facilities for a coil material of the present example, a heating device 230 capable of reheating the cast material 1A until the cast material 1A is coiled with the coiler 220 is disposed and, in addition, non-contact type thermometers 240, 240, and 240 capable of measuring surface temperatures of three places, that is, an intermediate portion in the width direction of the cast material 1A just before being coiled by the coiler 220 and both edge portions, are disposed. A central thermometer 240 is disposed at the center in the width direction of the cast material 1A and the thermometers 240 and 240 on both sides are disposed 20 mm or more inside from their respective side edge of the cast material 1A. The above described heating device 230 can change the heating temperature in the width direction of the cast material 1A and, therefore, can change the temperature in the width direction of the cast material 1A.

TEST EXAMPLE 2-1

The cast material 1A was continuously produced by the above described production facilities for a coil material and a plurality of coil materials 2 (Samples 4-1 to 4-9 shown in Table V) were produced by coiling the cast material 1A into the shape of a coil. Regarding all the samples, the size of the cast materials 1A were the same (length 200 m, average width 300 mm, average sheet thickness 5 mm, sheet thickness variation ±0.3 mm or less) and the numbers of turns of the coil materials 2 were the same (45 turns). Furthermore, the coiling tension of the cast material 1A was specified to be constant at about 400 kgf/cm$^2$ by controlling the rotation speed of the winding drum 221 of the coiler 210. In this regard, sheet thickness of the cast material 1A was determined by averaging a plurality of measurement results measured with non-contact type measuring instruments disposed in the vicinity of the outlet of the casting rolls 211 and 211. The numerical values were measured at three places, that is, an intermediate portion in the width direction of the cast material 1A and both edge portions every 10 m of the cast material 1A between the position 10 m from the coiling end and the coiling finish end. The measurement positions of the sheet thickness of the cast material 1A were the same as the measurement positions of the temperature of the cast material 1A, that is, the center in the width direction of the cast material 1A and the positions 20 mm inside the side edges of the cast material 1A.

Meanwhile, in production of the individual samples, the temperature in the width direction of the cast material 1A just before coiling was changed by switching on/off of the heating device 230. The on/off of the heating device 230 was controlled on the basis of the surface temperature of the cast material 1A measured with the thermometers 240, 240, and 240 from the point in time of 10 m of production from the coiling end of the cast material 1A with time (that is, continuously (or intermittently) in the longitudinal direction of the cast material 1A).

Regarding each of the samples produced as described above, d (mm), which was an indicator of unevenness of the intermediate portion in the width direction of the coil material 2, was measured. The sample production condition and the measurement results of the unevenness indicator d are shown in Table V.

TABLE V

| Sample No. | Coiling tension (kgf) | Temperature in width direction of cast material just before coiling (° C.) | | Temperature difference between temperature of intermediate portion and temperature of both edge portions | Unevenness of coil intermediate portion d (mm) |
|---|---|---|---|---|---|
| | | Intermediate portion | Both edge portions | | |
| 4-1 | 400 | 150 | 135 | 15 | 0.5 |
| 4-2 | 400 | 180 | 150 | 30 | 1 |
| 4-3 | 400 | 200 | 150 | 50 | 2 |
| 4-4 | 400 | 250 | 200 | 50 | 2 |
| 4-5 | 400 | 250 | 150 | 100 | 7 |
| 4-6 | 400 | 350 | 300 | 50 | 2.5 |
| 4-7 | 400 | 380 | 330 | 50 | 2.5 |
| 4-8 | 400 | 120 | 150 | −30 | 6 |
| 4-9 | 400 | 150 | 180 | −30 | 6 |

The temperature in the width direction of the cast material 1A in Table V is an average temperature of the surface temperatures of the cast material 1A measured from the point in time of 10 m of production from the coiling end of the cast material 1A up to the coiling finish end. In this regard, the temperature of both edge portions in Table V is an average value of the temperatures of lateral end portions. A negative temperature difference in the width direction of the cast material 1A indicates that the temperature of the intermediate portion is lower than the temperature of both edge portions. Meanwhile, as shown in FIG. 7, the indicator d (mm) of dent of the intermediate portion in the width direction of the resulting magnesium alloy cast coil material 2 was determined by measuring the maximum distance among distances from a straight line (straight line parallel to the axial line of the winding drum 221) circumscribing both end surfaces of the resulting magnesium alloy cast coil material 2 to the perimeter surface of the coil material 2 with a commercially available feeler gauge.

As is clear from the results shown in Table V, the coil material produced in such a way that the temperature of the intermediate portion in the width direction of the cast material just before coiling was higher than the temperature of both edge portions and the temperature difference between the intermediate portion and the both edge portions became 50° C. or less was in the shape of a Japanese hand drum in which the intermediate portion in the width direction was dented. Furthermore, the dent d (mm) thereof was within the range of 0.0001×w to 0.01 w=0.03 mm to 3 mm (w is a width of the cast material 1A and is 300 mm in the present example). As a result of observation of both end surfaces of the coil material, gaps were hardly formed between turns of the coil material 2, and all gaps formed were 1 mm or less. As gaps are hardly formed, it can be said that the flatness of the cast material constituting the coil material is high. Therefore, the quality of a fabricated article produced by using this coil material can be improved.

On the other hand, regarding the coil material produced in such a way that the temperatures of both edge portions in the width direction of the cast material just before coiling became higher than the temperature of the intermediate portion or the coil material produced in such a way that the temperature difference between the intermediate portion and the both edge portions became more than 50° C., the dent d was out of the range of 0.03 mm to 3 mm. As a result of observation of both end surfaces of the coil materials, gaps were observed here and there between turns of the coil material and most of the gaps were more than 1 mm. Consequently, it is believed that the flatness of the cast material 1A constituting these coil materials is lower than that of the coil material having a value of the dent d satisfying the above described range.

EXAMPLE 3-1

Next, a method for manufacturing a magnesium alloy cast coil material, the method being suitable for use in casting and coiling sheet materials in Examples 1-1 to 2-2 described above and other examples described later, as a matter of course, and being widely applicable to production of magnesium alloy cast coil materials regardless of the presence or absence of the conditions specified in these examples, and a magnesium alloy cast coil material obtained by the method will be described. According to this technology, a sheet material having an odd-form cross-sectional shape can be obtained by allowing a nozzle used for casting to take on a specific shape. This method for manufacturing a magnesium alloy cast coil material includes a step to feed a molten metal of a magnesium alloy to a continuous casting machine and produce and coil long lengths of cast sheet. Furthermore, a nozzle to feed the above described molten metal to a mold of the continuous casting machine is configured in such a way that the side surface of the above described cast sheet takes on a shape having at least one curved portion.

According to this manufacturing method, for example, a magnesium alloy cast coil material formed from a cast sheet having a specific cross-sectional shape described below can be produced. This magnesium alloy cast coil material is produced by coiling long lengths of cast sheet formed from a magnesium alloy. In the cross-sectional surface of the above described cast sheet, the side surface of this cast sheet takes on a shape having at least one curved portion, and a maximum protrusion distance of the above described curved portion in the direction orthogonal to the thickness direction of the above described cast sheet is 0.5 mm or more.

In the above described manufacturing method, the nozzle is configured in such a way that the side surface of the cast sheet takes on a shape having a convex portion or concave portion, as described above, and therefore, all over the inner side surface of the nozzle is not uniformly flat to obtain a cast sheet taking on a rectangular cross-sectional surface. Through the use of such a nozzle can reduce the problems, e.g., chipping of an edge portion, an occurrence of cracking, and solidification in a nozzle, effectively. The reason for this is believed to be that the molten metal is not easily filled into the above described convex portion or concave portion formation place in the nozzle, the contact area of the molten metal and the nozzle inside surface is reduced, cooling of the molten metal in the nozzle is reduced and, thereby, a decrease in flow rate of the molten metal and occurrence and development of solidified materials can be reduced.

Consequently, according to the above described manufacturing method, a cast sheet composed of a magnesium alloy can be produced continuously and stably. For example, long lengths of cast sheet having a length of 30 m or more, furthermore 100 m or more, or in particular 400 m or more can be produced, and by coiling this cast sheet, a cast coil material having a length of cast sheet of 30 m or more is obtained. Moreover, regarding this cast sheet, chipping, cracking, and the like of the edge portion are at low levels, so that a predetermined width can be ensured sufficiently. Therefore, according to this manufacturing method, the amount of trimming of the resulting cast sheet is reduced, the yield can be improved, and a coil material (typically, a cast coil material) through coiling of such long lengths of cast sheet can be produced with high productivity.

The coil material obtained by the above described manufacturing method (typically, a cast coil material) is suitable for use as a raw material for a magnesium alloy structural member. More specifically, in production of the magnesium alloy structural member by uncoiling and subjecting the above described coil material to primary plastic forming, e.g., rolling, or by subjecting the resulting rolled sheet to various secondary forming, e.g., polishing processing, leveling process, and plastic forming (for example, press forming), appropriately, the raw material can be fed to a forming apparatus continuously. Consequently, the coil material and the cast coil material obtained by the above described manufacturing method can contribute to mass production of the magnesium alloy structural member, e.g., a press forming structural member.

As for the configuration of the cast material serving as this magnesium alloy cast coil material, the same composition, mechanical characteristics, and forms as those of the sheet material in Example 1-1 can be used.

In the above described manufacturing method, as for a typical form of the above described nozzle, a form composed of a pair of main body sheets disposed discretely and a pair of prism-shaped side dams which are disposed in such a way as to sandwich both edges of the above described main body sheets and which constitute a rectangular opening portion in combination with the above described main body sheets is mentioned.

In this method for manufacturing a coil material, for example, a nozzle formed integrally from a homogeneous material can be used. On the other hand, according to the above described configuration, in the case where the main body sheets, which mainly form front and back surfaces of the cast sheet and which guide the molten metal, and side dams, which mainly form the side surfaces of the cast sheet and which guide the molten metal are different structural members, the material of the individual members can be differentiated, or various three-dimensional shapes are formed easily by combination.

As for one form of the above described manufacturing method, a form in which at least a front end-side region of the inner side surface in contact with the above described molten metal of the above described side dam is in the shape of one mountain, where the central portion in the thickness direction of the above described nozzle is protruded and a dent is made from the central portion toward the above described main body sheet side, and a maximum distance between the protrusion portion and the above described concave portion is 0.5 mm or more is mentioned.

In order that the side surface of the cast sheet takes on the shape having a concave portion or a convex portion, as described above, the shape of the inner side surface of the above described side dam can be various shapes. In particular, in the case where the above described maximum distance is a specific size and a shape of one mountain protruding toward the inside of the nozzle is employed, the concave portion formed at the connection place of the above described main body sheet and the above described side dam is a narrow region as compared with the corner portion of a nozzle having a rectangular opening and, therefore, the concave portion is not easily filled with the molten metal sufficiently. Consequently, according to the above described form, solidification of the molten metal in the above described concave portion and chipping and cracking caused by the resulting solidified materials can be reduced effectively. Therefore, according to the above described form, chipping and cracking of edge portion are reduced, and a cast sheet having a size capable of ensuring a predetermined sheet width sufficiently can be produced with high precision stably.

It is expected that the above described solidification in the nozzle is suppressed easily when the maximum distance between the above described protrusion portion and the above described concave portion is, in particular, 1 mm or more and 4 mm or less.

In the case where the above described side dam having an inner side surface in the shape of one mountain is used, the cross-sectional shape of the side surface of the resulting cast sheet becomes a concave and convex shape, in which the central portion in the thickness direction is dented, a protrusion is made from the central portion toward the individual surfaces of the cast sheet, and a dent is made again, in brief, a shape in which two arcs are arranged side by side, or a two-mountain shape in which two mountains range. In the case where a side dam having an inner side surface in the shape in which a plurality of mountain range is used, the cross-sectional shape of the cast sheet becomes a concave and convex shape in which three or more of, that is, a plurality of, mountains range.

As for one form of the method for manufacturing this coil material, a form in which at least a front end-side region of the inner side surface in contact with the above described molten metal of the above described side dam is in the shape of an arc, where the central portion in the thickness direction of the above described nozzle is dented, and a maximum distance between the above described concave portion and the chord of the above described concave portion is 0.5 mm or more is mentioned.

According to the above described configuration, the shape of the nozzle opening portion becomes a shape in which a pair of main body sheets are joined by a smooth curve (typically, a racetrack shape). Consequently, according to the above described form, local solidification, which has occurred in the vicinity of the corner portion of the nozzle having a rectangular opening portion, can be reduced. Therefore, according to the above described form, chipping and cracking of the edge portion are reduced, and a cast sheet having a size capable of ensuring a predetermined sheet width sufficiently can be produced with high precision stably.

It is expected that the above described solidification in the nozzle is suppressed easily when the maximum distance between the above described concave portion and the chord of the above described concave portion is, in particular, 1 mm or more and 4 mm or less.

In the case where the above described side dam having an inner side surface in the shape of an arc is used, the cross-sectional shape of the side surface of the resulting cast sheet becomes a convex shape, in which the central portion in the thickness direction is protruded, typically a semi-arc shape.

As for one form of the method for manufacturing this coil material, a form in which the above described side dam has an inclined surface, where a corner portion formed by an end surface in the nozzle front end side and the inner side surface to come into contact with the above described molten metal is removed, and an angle θ is 5° or more and 45° or less, where the angle formed by the above described inclined surface and a virtual extended surface of the above described inner side surface is represented by θ. In particular, the above described side dam is disposed in such a way as to make the ridge of the above described inclined surface and the above described inner side surface locate in the side inner than the front end edge of the above described main body sheet.

In plan view in the thickness direction of the nozzle provided with the above described configuration, the vicinity of the opening portion of the nozzle is in the shape of a taper divergent frontward in the movement direction of the flow of the molten metal. As the vicinity of the outlet (opening portion of the nozzle) of the molten metal is in the shape of a taper, the molten metal flowing along the above described inner side surface can be transferred to the mold of the continuous casting machine substantially without coming into contact with the inner side surface of the side dam in the vicinity of the above described outlet by adjusting the flow rate of the molten metal. That is, according to the above described form, cooling of the molten metal by the side dam in the vicinity of the above described outlet can be prevented efficiently, and the molten metal in a high-temperature state can be transferred to the mold. Therefore, according to the above described form, chipping and cracking of the edge portion are reduced, and a cast sheet having a size capable of ensuring a predetermined sheet width sufficiently can be produced with high precision stably. Furthermore, the molten metal is not supported by the side dam in the vicinity of the above described outlet and, thereby, the side surface of the resulting cast sheet tends to take on a shape having at least one curved portion.

If the above described θ is less than 5° or more than 45°, solidified materials may be generated and chipping and cracking of the edge portion occur easily, as in the above described nozzle having a rectangular opening portion. It is more preferable that θ is 20° or more and 40° or less.

Even when the above described inclined surface is disposed, the case where the ridge of the above described inclined surface and the above described inner side surface is located in the side outer than the front end edge of the above described main body sheet, that is, the case where the above described inclined surface is present at a place exposed out of the main body sheet, is equal to the case where the above described nozzle having a rectangular opening portion is used. Therefore, in this case, it is difficult to suppress the above described occurrences of solidification of the corner portion in the nozzle and chipping and cracking of the edge portion. Then, it is proposed that the side dam is disposed in such a way as to make the above described ridge locate in the side inner than the front end edge of the above described main body sheet. Meanwhile, if the above described θ is small and the distance between the above described ridge and the front end edge of the main body sheet is too large, the molten metal is guided easily to the outlet of the nozzle while being in contact with the side dam in a manner similar to that of the nozzle having a rectangular opening portion. Therefore, the distance between the ridge and the front end edge of the main body sheet is preferably 5 mm or less.

In the case where the above described inclined surface is disposed on the side dam in such a way that the side surface of the above described cast sheet takes on a shape having at least one curved portion, as described above, the molten metal can be transferred to the mold while being held in a high temperature state and, thereby, occurrences of chipping and cracking of the edge portion can be prevented more effectively.

Next, the magnesium alloy cast coil material having a feature in the cross-sectional shape and a method for manufacturing the same will be described in more detail with reference to FIG. 8A, FIG. 8B to FIG. 10A, and FIG. 10B. FIG. 8B and FIG. 9B show only a left half of the cross-section of a casting nozzle, although a right half is present actually. Furthermore, in FIG. 8A, FIG. 8B to FIG. 10A, and FIG. 10B, the shape in the thickness direction is emphasized in order that the shape of the side surface of the cast sheet and the inner side surface of the nozzle are easy to understand. The casting nozzles used in the following individual examples can be applied to other examples, as a matter of course, and be applied to production of magnesium alloy cast coil materials regardless of the presence or absence of the conditions specified in the other examples.

EXAMPLE 3-2

A magnesium alloy cast coil material according to Example 3-2 and a method for manufacturing the same will be described with reference to FIG. 8A and FIG. 8B. This magnesium alloy cast coil material (not shown in the drawing) is produced by coiling long lengths of cast sheet 1B composed of a magnesium alloy. The feature of this cast coil material is the cross-sectional shape of the cast sheet 1B.

Figure 8A:
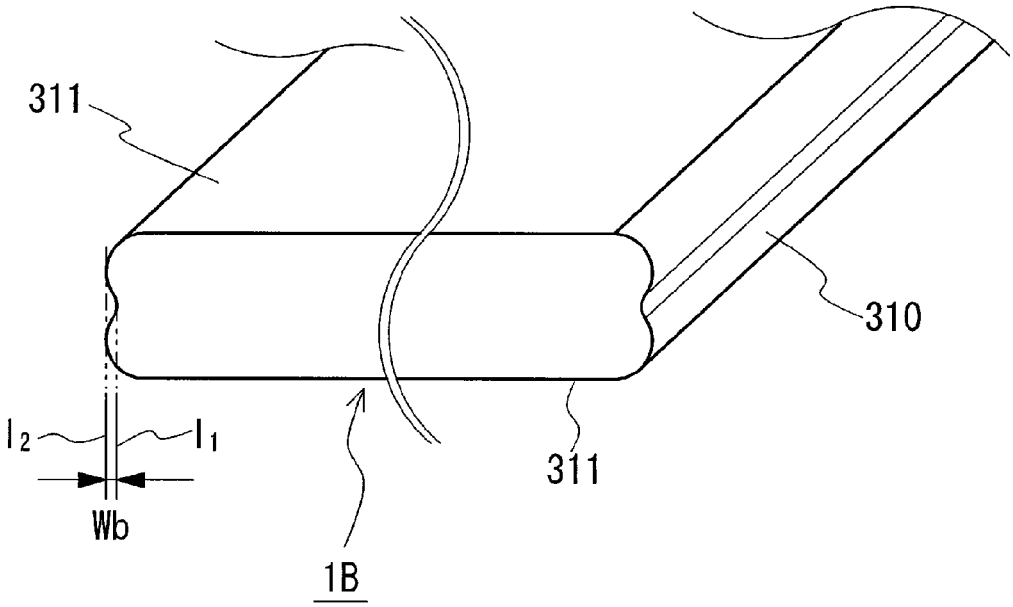
[FIG. 8A]
Figure 8B:
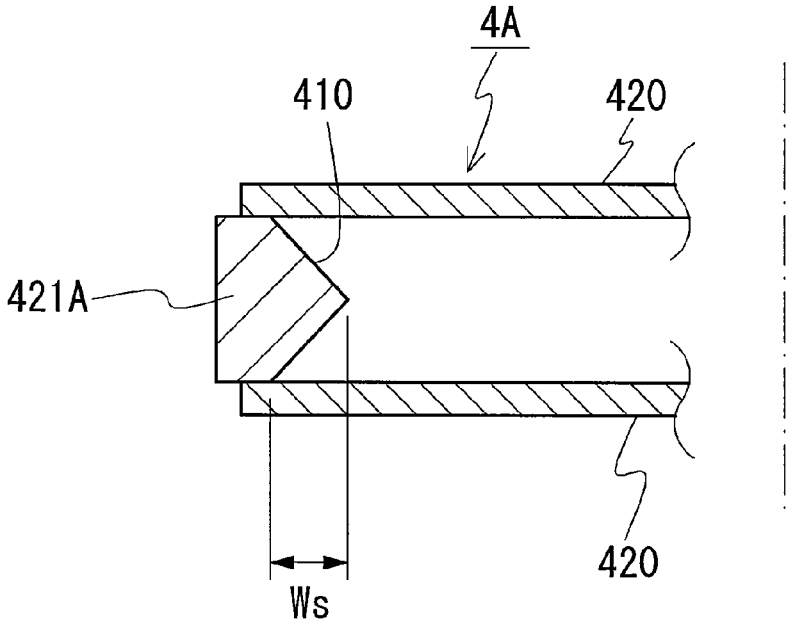
[FIG. 8B]

In the cross-section (FIG. 8A shows the end surface) of the cast sheet 1B, a side surface 310 is in a concave and convex shape. Specifically, the side surface 310 takes on a shape in which the central portion in the thickness direction of the cast sheet 1B is dented, a protrusion is made from the central portion toward the individual surfaces 311 of the cast sheet 1B, and a dent is made again, in brief, a two-mountain shape in which two semi-arcs are arranged side by side. Regarding the convex portion of the side surface 310, a maximum protrusion distance Wb in the direction orthogonal to the thickness direction of the cast sheet 1B is 0.5 mm or more. Here, the maximum protrusion distance Wb is specified to be the distance between straight lines $\mathbf{1}_1$ and $\mathbf{1}_2$, where the line $\mathbf{1}_1$ is a straight line in the thickness direction orthogonal to the surface 311 of the cast sheet 1B and passes through a most dented point of the concave portion of the side surface 310 and the straight line $\mathbf{1}_2$ passes through a most protruded point of the convex portion of the side surface 310.

The thickness, the width, and the length of the cast sheet 1B can be selected appropriately. In the case where the above described cast coil material is used as a raw material for a rolled sheet serving as a raw material of a plastic forming structural member, e.g., a press forming structural member, when the thickness of the cast sheet is 10 mm or less, furthermore 7 mm or less, and in particular 5 mm or less, segregation and the like are not present easily and the strength is excellent. The width of the cast sheet 1B can be selected in accordance with, for example, the size of the above described plastic forming structural member or the rolled sheet, and 100 mm to 900 mm is mentioned. The length of the cast sheet 1B can be specified to be very long lengths, e.g., 30 m or more and furthermore 100 m or more, or be short depending on uses.

The long lengths of cast sheet 1B provided with the side surface 310 in the above described specific shape can be produced by a continuous casting process through the use of a casting nozzle 4A shown in FIG. 8B. The nozzle 4A is a cylindrical body formed from a pair of main body sheets 420 and a pair of prism-shaped side dams 421A which constitute a rectangular opening portion in combination with the main body sheets 420. The main body sheets 420 are disposed discretely at a predetermined interval (the interval designed in accordance with the thickness of the cast sheet 1B), and the side dams 421A are combined in such a way as to sandwich both edges of these main body sheets 420.

The side dam 421A has a feature particularly in the shape of the inner side surface 410 having a cross-section taking on a one-mountain shape in which the central portion in the thickness direction of the nozzle 4A is protruded toward the inside of the nozzle 4A and a dent is made from this central portion toward the main body sheets 420 side. Here, the inner side surface 410 takes on the above described one-mountain shape throughout the region in the longitudinal direction of the side dam 421A. The inner side surface 410 does not necessarily take on a uniform shape throughout the length as described above. For example, in the inner side surface 410, only a front end-side region of the nozzle 4A (for example, a region which is from the front end edge of the main body sheet 420 toward the inside of the nozzle 4A and which is 10% or less of the length of the main body sheet 420) may take on the above described one-mountain shape, or a region, which is from the front end edge of the main body sheet 420 toward the inside of the nozzle 4A and which is more than 10% of the length of the main body sheet 420, may take on the above described one-mountain shape. In the case where a uniform shape is employed throughout the length of the inner side surface 410, the side dams are formed easily. In this regard, as for the above described one-mountain shape, a form composed of flat surfaces is shown here, although a form composed of curved surfaces, for example, an arc shape or a corrugated shape, can be employed.

Regarding the inner side surface 410 in the above described one-mountain shape, the maximum distance Ws between the protruded portion and the dented portion is 0.5 mm or more. Here, the maximum distance Ws corresponds to a distance from the most protruded point to a plane which is in the thickness direction of the nozzle 4A and which includes the ridge of the inside surface of the main body sheet 420 and the inner side surface 410. The molten metal of the magnesium alloy is guided by this inner side surface 410 in the one-mountain shape and is transferred to the mold and, thereby, the side surface 310 of the cast sheet 1B takes on a concave and convex shape, as if the shape of the inner side surface 410 of the above described nozzle 4A is transferred.

As for the constituent materials for the nozzle 4A, materials having excellent heat resistance and high strength, for example, aluminum oxide, silicon carbide, calcium silicate, alumina sintered body, boron nitride sintered body, carbon based materials, and glass fiber containing materials, can be used. Oxide materials react with molten magnesium easily.

Therefore, in the case where the oxide material is used as the constituent material for the nozzle 4A, it is preferable that a low-oxygen layer formed from a material having a low oxygen content is disposed at a place in contact with the molten metal. Examples of constituent materials for the low-oxygen layer include at least one type selected from boron nitride, graphite, and carbon. The constituent materials for the main body sheet 420 and the side dam 421A may be the same type of be different.

As for the above described continuous casting process, a twin-roll casting process or a twin-belt casting process can be used. The continuous casting process is preferable because oxides, segregation, and the like can be reduced by quenching and solidifying the molten metal and, in addition, generation of coarse impurities in crystal and precipitates exceeding 10 μm can be suppressed. In particular, the twin-roll casting process is preferable because quenching and solidification can be performed by using a mold exhibiting excellent rigidity and heat conductivity and having a large heat capacity, so that a cast sheet including a low extent of segregation can be formed. A higher cooling rate during casting is preferable. For example, if the cooling rate is specified to be 100° C./sec or more, deposits generated at interfaces of columnar crystals can be made fine, e.g., 20 μm or less.

The nozzle 4A is disposed in the continuous casting machine, the molten metal of a magnesium alloy is discharged from the nozzle 4A and, in addition, the molten metal is quenched and solidified with the mold, so as to produce the cast sheet 1B continuously. Subsequently, the resulting long lengths of cast sheet 1B is coiled with a coiler appropriately, so that a cast coil material can be produced. The inside diameter and the outside diameter of the cast coil material can be selected appropriately in accordance with, for example, the thickness and the length of the cast sheet. However, if the inside diameter is too small or the thickness is too large, cracking or the like may occur in the cast sheet when the cast sheet is coiled. It is preferable that the inside diameter is small, because coiling can be performed without an occurrence of cracking by controlling the temperature just before the cast sheet is coiled, as in Example 1-1.

In the case where the casting nozzle 4A having the inner side surface 410 in the above described concave and convex shape is used, chipping and cracking of the edge portion are suppressed and long lengths of cast sheet composed of a magnesium alloy can be produced continuously and stably, as shown in a test example described later. Furthermore, long lengths of cast sheet 1B can be produced continuously and stably by specifying the cross-sectional shape of the cast sheet 1B to be a specific concave and convex shape.

Chipping and cracking of the edge portion can be further suppressed by adjusting the production condition (for example, the temperature of molten metal, the cooling rate, the temperature in a tundish, the transfer pressure of molten metal, and the like) in addition to use of the nozzle in the specific shape, as described above.

EXAMPLE 3-3

A magnesium alloy cast coil material according to Example 3-3 and a method for manufacturing the same will be described with reference to FIG. 9A and FIG. 9B. The basic configuration of Example 3-3 is the same as the cast coil material 1B and the manufacturing method (casting nozzle 4A) in Example 3-2 described above, and main difference is in the side surface shape of a cast coil material 1C and the shape of the inner side surface of the casting nozzle 4B used for production of the cast coil material 1C. This difference will be described below in detail, and detailed explanations of the same configurations and effects as those in Example 3-2 are omitted.

Figure 9A:
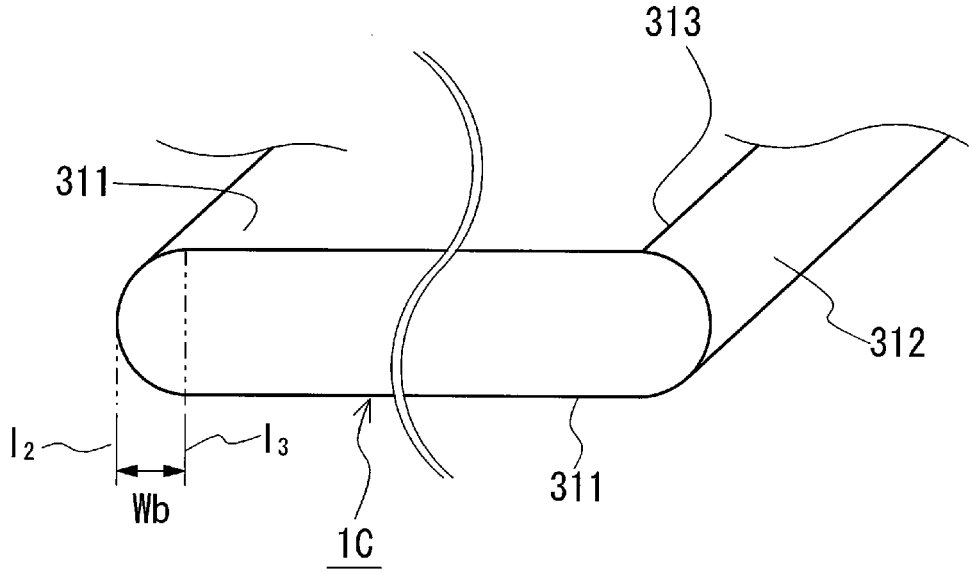
[FIG. 9A]
Figure 9B:
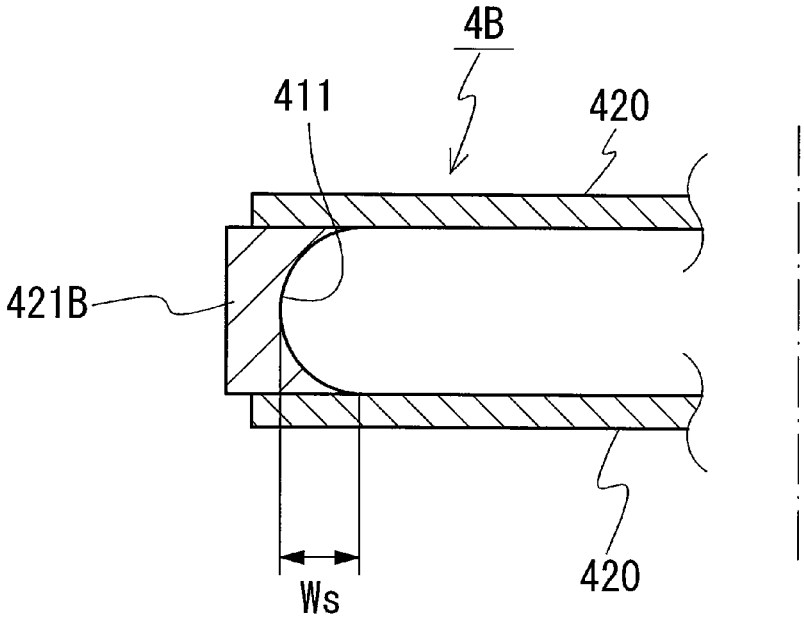
[FIG. 9B]

In the cross-section (FIG. 9A shows the end surface) of the cast sheet 1C, a side surface 312 is formed from a curved surface. Specifically, the side surface 312 takes on a shape in which the central portion in the thickness direction of the cast sheet 1C is bulged, and convergence is made from the central portion toward the individual surfaces 311 of the cast sheet 1C, in brief, a semi-arc shape. Regarding the convex portion of the side surface 312, a maximum protrusion distance Wb in the direction orthogonal to the thickness direction of the cast sheet 1C is 0.5 mm or more. Here, the maximum protrusion distance Wb is specified to be the distance between straight lines $\mathbf{1}_2$ and $\mathbf{1}_3$, where the line $\mathbf{1}_2$ is a straight line in the thickness direction orthogonal to the surface 311 of the cast sheet 1C and passes through a most protruded point of the concave portion of the side surface 312 and the straight line $\mathbf{1}_3$ passes through a ridge 313 of the side surface 312 and the surface 311. The ridge 313 is typically a straight line passing through an inflection point on the surface 311.

The long lengths of cast sheet 1C provided with the side surface 312 in the above described specific shape can be produced by a continuous casting process through the use of a casting nozzle 4B shown in FIG. 9B. The nozzle 4B is a cylindrical body formed from a pair of main body sheets 420 and a pair of prism-shaped side dams 421B in a manner similar to the nozzle 4A in Example 3-1.

The side dam 421B has a feature particularly in the shape of the inner side surface 411 having a cross-section taking on a concave shape in which the central portion in the thickness direction of the nozzle 4B is dented and the width of the side dam 421B increases from this central portion toward the main body sheets 420 sides. The width of the side dam 421B refers to the size in a direction (in FIG. 9A and FIG. 9B, transverse direction) orthogonal to the thickness direction (in FIG. 9A and FIG. 9B, vertical direction) of the nozzle 4B. Meanwhile, here, the inner side surface 411 takes on the above described concave shape all over the region in the longitudinal direction of the side dam 421B. Here, as for the above described concave shape, a form composed of curved surfaces is shown, although a form composed of flat surfaces, specifically, a one-mountain shape shown in Example 3-2 (where the direction of concave is reversed), can be employed.

Regarding the inner side surface 411 in the above described concave shape, the maximum distance Ws between the above described concave portion and the chord of the concave portion is 0.5 mm or more. Here, the maximum distance Ws corresponds to a distance from the most dented point to a plane which is in the thickness direction of the nozzle 4A and which includes the ridge of the inside surface of the main body sheet 420 and the inner side surface 411 of the side dam 421B. The above described chord of the concave portion corresponds to a straight line bonding the two ridges in the thickness direction. The molten metal of the magnesium alloy is guided by this inner side surface 411 in the concave shape and is transferred to the mold and, thereby, the side surface 312 of the cast sheet 1C takes on a convex shape, as if the shape of the inner side surface 411 of the above described nozzle 4B is transferred.

In the case where the continuous casting process, e.g., the twin-roll casting process by using the casting nozzle 4B having the inner side surface 411 in the above described concave shape, is performed, chipping and cracking of the edge portion are suppressed and long lengths of cast sheet composed of a magnesium alloy can be produced continuously and stably, as shown in a test example described later. Furthermore, long lengths of cast sheet 1C can be produced continuously and stably by specifying the cross-sectional shape of the cast sheet 1C to be a specific convex shape.

EXAMPLE 3-4

Figure 10A:
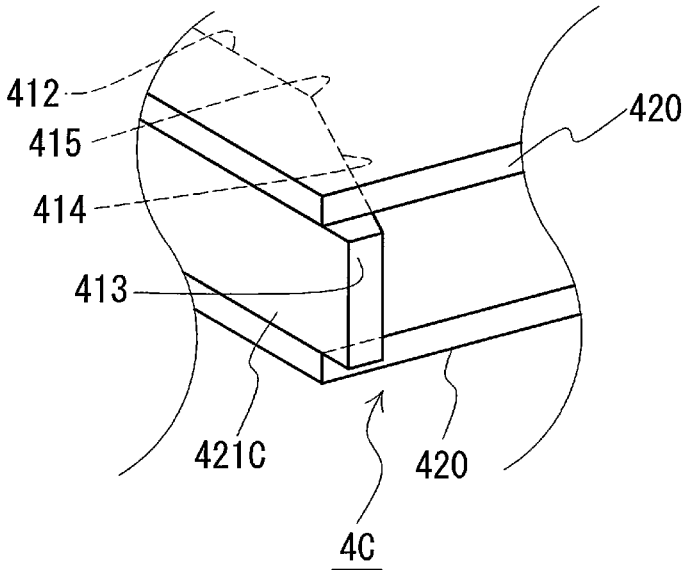
[FIG. 10A] FIG. 10 schematically shows the vicinity of an opening portion of a casting nozzle used for a method for manufacturing a magnesium alloy cast coil material in Example 3-4.

A method for manufacturing a magnesium alloy cast coil material according to Example 3-4 will be described with reference to FIG. 10A and FIG. 10B. The basic configuration of Example 3-4 is the same as the method for manufacturing a cast coil material (casting nozzle 4A) in Example 3-2 described above, and main difference is in the shape of the casting nozzle used for production of the cast coil material. This difference will be described below in detail, and detailed explanations of the same configurations and effects as those in Example 3-2 are omitted.

The casting nozzle 4C is a cylindrical body formed from a pair of main body sheets 420 and a pair of prism-shaped side dams 421C in a manner similar to the nozzle 4A in Example 3-2. The side dam 421C has a feature in the shape of the front end portion (a portion in the nozzle opening side). Specifically, a corner portion formed by an end surface 413 in the front end side of the nozzle 4C of the side dam 421C and the inner side surface 412 of the side dam 421C is removed, and the side dam 421C is provided with an inclined surface 414 in the front end side. The angle A formed by the inclined surface 414 and a virtual extended surface of the inner side surface 412 is 5° to 45°. In this regard, the inner side surface 412 of the nozzle 4C in Example 3-4 is formed from flat surfaces and has no curved portion in contrast to the side dams 421A and 421B in Examples 3-1 and 3-2.

Figure 10B:
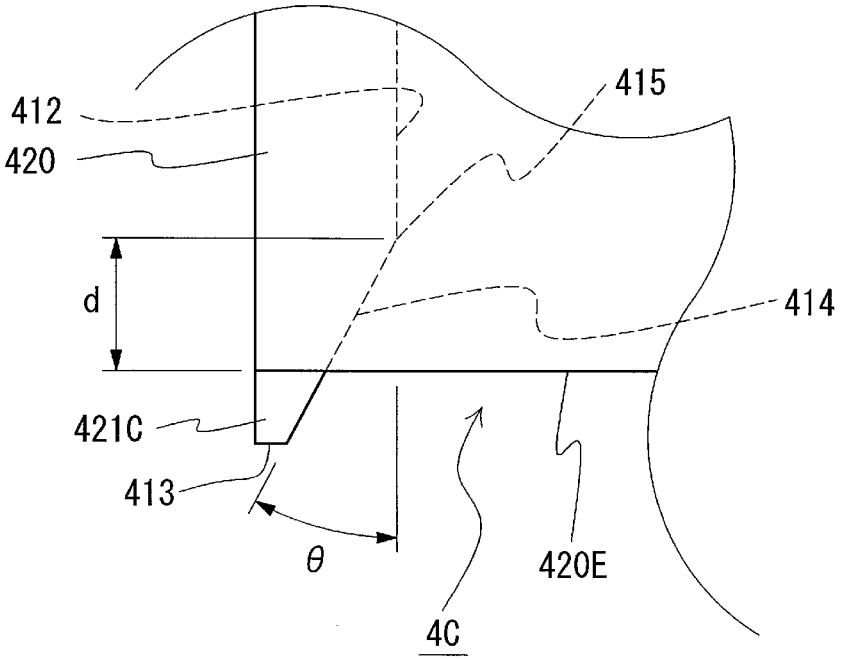
[FIG. 10B] FIG. 10 schematically shows the vicinity of an opening portion of a casting nozzle used for a method for manufacturing a magnesium alloy cast coil material in Example 3-4.

Furthermore, in the casting nozzle 4C, a front end edge 420E of the main body sheet 420 and an end surface 413 of the side dam 421C are disposed while being displaced with respect to each other in the longitudinal direction of the nozzle 4C (in FIG. 10B, vertical direction, equal to the transfer direction of molten metal). Specifically, the side dam 421C is disposed in such a way that the end surface 413 of the side dam 421C protrudes forward from the front end edge 420E of the main body sheet 420 in the transfer direction of the molten metal. That is, the side dam 421C is disposed in such a way as to make the ridge 415 of the inclined surface 414 and the inner side surface 412 locate in the side inner than the front end edge 420E of the main body sheet 420.

In the case where casting is performed by the continuous casting process, e.g., the twin-roll casting process, by using the casting nozzle 4C provided with the above described inclined surface 414, by adjusting the flow rate of the molten metal of the magnesium alloy flowing into the nozzle 4C and, in addition, adjusting the distance d between the above described ridge 415 and the front end edge 420E of the main body sheet 420, the molten metal can be discharged toward the mold on an as-is basis without being guided by the side dam 421C at the front end portion of the nozzle 4C. That is, the nozzle 4C can be configured to include a place not in contact with the molten metal (here, front end portion). According to the above described configuration, in particular at the front end portion of the nozzle 4C, the molten metal is effectively prevented from being cooled by the side dam 421C and, thereby, the molten metal in the high-temperature state can be transferred to the front end of the nozzle 4C. The distance d between the above described ridge 415 and the front end edge 420E of the main body sheet 420 is specified to be 5 mm or less.

The molten metal flowing in the above described casting nozzle 4C is not guided by the side dam 421C at the front end portion of the nozzle 4C, as described above, and therefore, is in the state of being deformed freely to some extent. Consequently, by performing continuous casting through the use of the nozzle 4C, a cast sheet in the shape having at least one curved portion in the side surface, for example, the cast sheet 1B having the side surface 310 in the concave and convex shape in Example 3-2 and the cast sheet 1C having the side surface 312 in the convex shape in Example 3-3, can be produced.

In the case where the casting nozzle 4C provided with the above described side dam 421C subjected to corner removal is used, regarding production of the cast sheet having the side surface in the above described specific shape by the continuous casting process, e.g., the twin-roll casting process, chipping and cracking of the edge portion are suppressed and long lengths of cast sheet composed of the magnesium alloy can be produced continuously and stably.

MODIFIED EXAMPLE 3-1

Regarding the nozzles described in Examples 3-2 and 3-3 and having the inner side surfaces in the specific shapes, the shape in the front end side thereof can be made into a shape, in which the corner is removed, as described in Example 3-4.

TEST EXAMPLE 3-1

The casting nozzles 4A and 4B of Examples 3-2 and 3-3 and a casting nozzle having a rectangular opening portion for comparison were prepared. Continuous casting was performed with a twin-roll casting machine, so as to produce cast sheets continuously and the productivity was evaluated.

In this test, a molten metal of a magnesium alloy having a composition (Mg-9.0% Al-1.0% Zn (all in percent by mass)) corresponding to the AZ91 alloy was prepared. A cast sheet having a thickness of 5 mm and a width of 400 mm was produced continuously, and a length (m) which can be produced without an occurrence of chipping of the edge portion of the cast sheet was examined. Regarding each of the casting nozzle 4A of Example 3-2 and the casting nozzle 4B of Example 3-3, the maximum distance Ws was specified to be 1.0 mm.

As a result, in either of the cases where casting nozzles 4A and 4B were used, long lengths of cast sheet having a length of 400 m was able to be produced continuously. Furthermore, chipping and cracking of the edge portion of the resulting cast sheet were at a low level throughout the length and, therefore, it is expected that the amount of removal due to trimming can be reduced. In this regard, the resulting long lengths of cast sheet was coiled, so as to produce a coil material. Meanwhile, in the case where the casting nozzle prepared for comparison was used, chipping and cracking of the edge portion increased at the point in time when 15 m of cast sheet was produced and the production was stopped.

Regarding the above described casting nozzles 4A and 4B, corners of the front ends of the side dams 421A and 421B were removed (θ=30°, d=3 mm), as described in Example 3-4, and cast sheets were produced in a manner similar to that in the above described test example. As a result, long lengths of cast sheet having a length of 400 m was able to be produced as in the above described test result. Moreover, chipping and cracking of the edge portion of the resulting cast sheets was at a low level. Therefore, chipping and cracking of the edge portion were able to be further reduced by combining the casting nozzles 4A and 4B with the configuration of removal of corner.

It was ascertained from the above described test results that long lengths of cast sheet composed of a magnesium alloy was able to be produced continuously and stably by using the casting nozzle in the specific shape.

In this regard, the above described examples can be modified appropriately within the bound of not departing from the gist of the present invention, and are not limited to the above described configurations. For example, the composition (types and contents of additive elements) of the magnesium alloy, the thickness, the width, and the length of the magnesium alloy cast coil material, the shape of the inner side surface of the side dam, the maximum protrusion distance, and the like can be changed appropriately. Furthermore, by combination of the technology of Example 1-1 described above and the technologies of Examples 2-1 and 2-2, a coil material in the shape of a Japanese hand drum coiled with a small diameter can be obtained. Moreover, by combination of the technology of Example 1-1 described above and the technologies of Examples 3-1 to 3-4, a coil material produced by coiling a sheet material having a non-rectangular cross-section with a small diameter can be obtained. In addition, by combination of the technology of Example 1-1, Examples 2-1 and 2-2, and the technologies of Examples 3-1 to 3-4, a coil material in the shape of a Japanese hand drum can be obtained by coiling a sheet material having a non-rectangular cross-section with a small diameter.

INDUSTRIAL APPLICABILITY

The magnesium alloy sheet according to the present invention are suitable for use as structural members of various electric and electronic devices, in particular housings of mobile and small electric and electronic devices, and raw materials for constituent structural members in various fields, e.g., automobiles and aircraft, in which high strength is desired. Furthermore, the magnesium alloy cast coil material according to the present invention is suitable for use as the raw material for the above described magnesium alloy sheet according to the present invention. The method for manufacturing a magnesium alloy cast coil material according to the present invention is suitable for use in production of the above described magnesium alloy cast coil material according to the present invention. The method for manufacturing a magnesium alloy sheet according to the present invention is suitable for use in production of the above described magnesium alloy sheet according to the present invention.

REFERENCE SIGNS LIST

1 sheet material

110 continuous casting machine 120 coiler 121 winding drum 122 chuck portion

122*a*, 122*b* grasping piece

123*a* convex portion 123*b* concave portion 125 thermometer 130, 131 heating device

1A cast material 1A' molten metal

2 magnesium alloy cast coil material

210 twin-roll type continuous casting machine 211 casting roll 212 casting nozzle

220 coiler 221 winding drum 230 heating device 240 temperature measuring device

1B, 1C cast sheet 310, 312 side surface 311 surface 313 ridge

4A, 4B, 4C casting nozzle 420 main body sheet 420E front end edge

421A, 421B, 421C side dam 410, 411, 412 inner side surface

413 end surface 414 inclined surface 415 ridge

The invention claimed is:

1. A method for manufacturing a coil material through coiling of a sheet material formed from a metal into the shape of a cylinder so as to produce the coil material, the method characterized by comprising the step of:

coiling the sheet material with a coiler while the Centigrade temperature T of the sheet material just before coiling is controlled to be a temperature at which the surface strain, (t/R)×100, wherein t represents the thickness and R represents the bending radius in millimeters, of the sheet material becomes less than or equal to the elongation at room temperature of the sheet material, wherein T is higher then 100, wherein the controlling of the Centigrade temperature T of the sheet material just before coiling is applied to a place grasped by a chuck portion provided in the coiler;

wherein the sheet material is a cast material of a magnesium alloy discharged from a continuous casting machine and the thickness t thereof is 7 mm or less, and a cast coil material having an elongation at room temperature of 10% or less is obtained, characterized in that the temperature of the sheet material is controlled in such a way as to make the temperature T of the sheet material just before coiling satisfy the following formula, where the minimum bending radius in coiling with the coiler is represented by Rmin, in millimeters:

$$\frac{\frac{(T-80)^2}{450}+30}{2800} \geqq \frac{t}{R\min}. \quad \text{[Equation 1]}$$

2. The method for manufacturing a coil material according to claim 1, characterized in that the t/R is 0.01 or more.

3. The method for manufacturing a coil material according to claim 1, characterized in that the sheet material is cast in such a way that the temperature just after being discharged from the continuous casting machine becomes 350° C. or lower.

4. The method for manufacturing a coil material according to claim 1, characterized in that the temperature of the sheet material discharged from the continuous casting machine is cooled to a temperature of 150° C. or lower, and the temperature of the sheet material just before coiling is controlled by heating at least a part of the sheet material to a temperature higher than the cooling temperature, before the cooled sheet material is coiled with the coiler.

5. The method for manufacturing a coil material according to claim 1, characterized in that the temperature of the sheet material just before coiling is controlled by disposing a heat insulating material between the continuous casting machine and the coiler.

6. The method for manufacturing a coil material according to claim 1, characterized in that the tensile strength of the resulting cast coil material at room temperature is 250 MPa or more.

7. The method for manufacturing a coil material according to claim 1, characterized in that the magnesium alloy contains at least one element selected from the group consisting of Al, Ca, and Si, and a formula value D represented by using the contents, in terms of percentage by mass of Al, Ca, and Si satisfies the following:

formula value $D=\{2.71\times(\text{Si content})+2.26\times[(\text{Al content})-1.35\times(\text{Ca content})]+2.35\times(\text{Ca content})\}\geq 14.5$.

8. The method for manufacturing a coil material according to claim 1, characterized in that the magnesium alloy contains at least one of element selected from the group consisting of Al, Ca, Si, Zn, Mn, Sr, Y, Cu, Ag, Sn, Li, Zr, Be, Ce, and rare earth elements excluding Y and Ce.

9. The method for manufacturing a coil material according to claim 1, characterized in that the continuous casting machine is a twin-roll casting machine, and casting is performed in such a way as to make the temperature of the sheet material in the range from a discharge port of the continuous casting machine to 500 mm in the moving direction of the sheet material becomes 250° C. or lower.

10. The method for manufacturing a coil material according to claim 4, characterized in that the heating temperature in heating of the sheet material is specified to be 350° C. or lower.

11. The method for manufacturing a coil material according to claim 4, characterized in that the coiler comprises a heating device, and the heating of the sheet material is performed by the heating device.

12. The method for manufacturing a coil material according to claim 1, characterized in that variations in temperature in the width direction of the sheet material just before coiling are specified to be within 50° C. and, in addition, the temperature of the sheet material is controlled in such a way as to make the temperature of an intermediate portion in the width direction of the sheet material higher than the temperature of both edge portions, and the sheet material is coiled while a constant coiling pressure of 300 kgf/cm$^2$ or more is applied.

13. The method for manufacturing a coil material according to claim 12, characterized in that variations in temperature in the longitudinal direction of the sheet material are specified to be within 50° C.

14. The method for manufacturing a coil material according to claim 12, characterized in that the measurement of the temperature of the sheet material just before coiling is started from the position of 10 m of production from the coiling end of the sheet material.

15. The method for manufacturing a coil material according to claim 1, characterized in that:

the continuous casting machine comprises a nozzle to feed a molten metal of a magnesium alloy to a mold, and the nozzle is configured to make the side surface of the sheet material take on a shape having at least one curved portion.

16. The method for manufacturing a coil material according to claim 15, characterized in that the nozzle is formed from a pair of main body sheets disposed discretely and a pair of prism-shaped side dams which are disposed in such a way as to sandwich both edges of the main body sheets and which constitute a rectangular opening portion in combination with the main body sheets, at least front end-side region of the inner side surface of the side dam to come into contact with the molten metal is in the shape of one mountain in which the central portion in the thickness direction of the nozzle is protruded and a dent is made from the central portion toward the main body sheet side, and a distance between the protruded portion and the dent portion is 0.5 mm or more.

17. The method for manufacturing a coil material according to claim 15, characterized in that the nozzle is formed from a pair of main body sheets disposed discretely and a pair of prism-shaped side dams which are disposed in such a way as to sandwich both edges of the main body sheets and which constitute a rectangular opening portion in combination with the main body sheets, at least front end-side region of the inner side surface of the side dam to come into contact with the molten metal is in the shape of an arc in which the central portion in the thickness direction of the nozzle is dented, and a distance between the dent portion and a chord of the dent portion is 0.5 mm or more.

18. The method for manufacturing a coil material according to claim 15, characterized in that the nozzle is formed from a pair of main body sheets disposed discretely and a pair of prism-shaped side dams which are disposed in such a way as to sandwich both edges of the main body sheets and which constitute a rectangular opening portion in combination with the main body sheets, the side dam has an inclined surface, where a corner portion formed by an end surface in the nozzle front end side and the inner side surface to come into contact with the molten metal is removed, an angle θ is 5° or more and 45° or less, where the angle formed by the inclined surface and a virtual extended surface of the inner side surface is represented by θ, and the side dam is disposed in such a way as to make the ridge of the inclined surface and the inner side surface located in the side inner than the front end edge of the main body sheet.

19. A coil material characterized by being formed from a cast sheet of a magnesium alloy, having a thickness of 7 mm, having an elongation at room temperature of 10% or less, and being coiled into the shape of a cylinder.

20. The coil material according to claim 19, characterized in that the tensile strength is 250 MPa or more.

21. The coil material according to claim 19, characterized in that the length of the cast sheet is 30 m or more.

22. The coil material according to claim 19, characterized in that the magnesium alloy contains at least one element selected from the group consisting of Al, Ca, and Si, and a formula value D represented by using the contents of Al, Ca, and Si satisfies the following:

$$\text{formula value } D=\{2.71\times(\text{Si content})+2.26\times[(\text{Al content})-1.35\times(\text{Ca content})]+2.35\times(\text{Ca content})\}\geq 14.5.$$

23. The coil material according to claim 19, characterized in that the magnesium alloy contains 7.3 percent by mass or more of at least one element selected from the group consisting of Al, Ca, Si, Zn, Mn, Sr, Y, Cu, Ag, Sn, Li, Zr, Be, Ce, and rare earth elements (excluding Y and Ce) as an additive element in total and the remainder composed of Mg and impurities.

24. The coil material according to claim 19, characterized in that the magnesium alloy comprises 7.3 percent by mass or more and 12 percent by mass or less of Al.

25. The coil material according to claim 19, characterized in that the magnesium alloy contains 0.1 percent by mass or more of at least one element selected from the group consisting of Y, Ce, Ca, and rare earth elements (excluding Y and Ce) and the remainder composed of Mg and impurities.

26. The coil material according to claim 19, characterized in that in a cross-section of the cast sheet, the side surface of the cast sheet is in the shape having at least one curved portion and a maximum protrusion distance of the curved portion in a direction orthogonal to the thickness direction of the cast sheet is 0.5 mm or more.

27. The coil material according to claim 19, characterized in that the maximum distance, which is represented by d (mm), among distances from a straight line circumscribing both end surfaces of the coil material produced by coiling the cast sheet to the perimeter surface of the cast coil material and the width, which is represented by w (mm), of the cast sheet satisfy $0.0001\ w<d<0.01\ w$, and the perimeter surface of the coil material is located in the side nearer to a core portion of the cast coil material than is the straight line.

28. The coil material according to claim 27, characterized in that gaps between turns of the coil material are 1 mm or less.

29. The coil material according to claim 27, characterized in that variations in sheet thickness of the cast sheet constituting the coil material are ±0.2 mm or less.

30. A method for manufacturing a magnesium alloy sheet, characterized by comprising the steps of:

preparing the coil material according to claim 19, and performing a heat treatment at a heat treatment temperature Tan (K) satisfying Tan (K) ≥Ts×0.8 for a holding time of 30 minutes or more, where the solidus temperature of the magnesium alloy constituting the coil material is represented by Ts (K) and the heat treatment temperature is represented by Tan (K), so as to produce a sheet.

31. The method for manufacturing a magnesium alloy sheet, according to claim 30, characterized in that the sheet is produced by performing rolling with a reduction ratio of 20% or more after the heat treatment.

32. A method for manufacturing a magnesium alloy sheet, characterized by comprising the steps of:

preparing the coil material according to claim 19, and producing a sheet by using the part constituting t×90% or more of the thickness t (mm) of the coil material.

33. A method for manufacturing a magnesium alloy sheet, characterized by comprising the steps of:

preparing the coil material according to claim 19, and subjecting the coil material to rolling with a reduction ratio of 20% or less, so as to produce the sheet.

34. A magnesium alloy coil material characterized by being obtained by the method for manufacturing a coil material according to claim 1.

35. A magnesium alloy sheet characterized by being obtained by the method for manufacturing a magnesium alloy sheet according to claim 30.

36. A coil material coiler to coil a sheet material continuously produced with a continuous casting machine into the shape of a cylinder, the coiler characterized by comprising:

a chuck portion to grasp an end portion of the sheet material; and a heating device to heat the region, which is grasped by the chuck portion, of the sheet material, wherein the sheet material is formed from a magnesium alloy.

37. The method for manufacturing a coil material according to claim 1, wherein the controlling of the Centigrade temperature T of the sheet material just before coiling is applied to the whole length of the sheet material from a place grasped by a chuck portion provided in the coiler to the coiler finishing place.

38. A method for manufacturing a coil material through coiling of a sheet material formed from a metal into the shape of a cylinder so as to produce the coil material, the method characterized by comprising the step of:

coiling the sheet material with a coiler while the Centigrade temperature T of the sheet material just before coiling is controlled to be a temperature at which the surface strain, (t/R) ×100, wherein t represents the thickness and R represents the bending radius in millimeters, of the sheet material becomes less than or equal to an elongation at room temperature of the sheet material, wherein T is higher than 100, wherein the controlling of the Centigrade temperature T of the sheet material just before coiling, is applied to a place grasped by a chuck portion provided in the coiler;

wherein the sheet material is a cast material of a magnesium alloy discharged from a continuous casting machine and the thickness t thereof is 7 mm or less, and a cast coil material having an elongation at room temperature of 10% or less is obtained, characterized in that the temperature of the sheet material is controlled in such a way as to make the temperature T of the sheet material just before coiling satisfy the following formula, where the minimum bending radius in coiling with the coiler is represented by Rmin, in millimeters:

$$\frac{\frac{(T-80)^2}{450}+30}{4000} \geqq \frac{t}{R\min}. \qquad \text{[Equation 2]}$$

* * * * *